US007905473B2

(12) United States Patent
Tamura et al.

(10) Patent No.: US 7,905,473 B2
(45) Date of Patent: Mar. 15, 2011

(54) SHEET CREASER INCLUDING A CAM GUIDED PRESSING UNIT

(75) Inventors: Masahiro Tamura, Kanagawa (JP); Nobuyoshi Suzuki, Tokyo (JP); Shuuya Nagasako, Kanagawa (JP); Naohiro Kikkawa, Kanagawa (JP); Kazuhiro Kobayashi, Kanagawa (JP); Tomohiro Furuhashi, Kanagawa (JP); Makoto Hidaka, Tokyo (JP); Junichi Tokita, Kanagawa (JP); Takashi Saito, Kanagawa (JP); Hitoshi Hattori, Tokyo (JP); Akira Kunieda, Tokyo (JP); Hiroshi Maeda, Gifu (JP); Ichiro Ichihashi, Aichi (JP); Atsushi Kuriyama, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 165 days.

(21) Appl. No.: 12/320,417

(22) Filed: Jan. 26, 2009

(65) Prior Publication Data

US 2009/0200725 A1 Aug. 13, 2009

(30) Foreign Application Priority Data

Feb. 13, 2008 (JP) ..... 2008-032229

(51) Int. Cl.
*B65H 37/06* (2006.01)
*B65H 37/04* (2006.01)

(52) U.S. Cl. ..... 270/32; 270/37; 270/45; 493/445

(58) Field of Classification Search ..... 270/32, 270/37, 45; 493/444, 445
See application file for complete search history.

(56) References Cited

U.S. PATENT DOCUMENTS

| | | | | |
|---|---|---|---|---|
| 6,783,124 | B2 | 8/2004 | Tamura et al. | |
| 7,014,183 | B2 | 3/2006 | Tamura et al. | |
| 7,407,155 | B2 | 8/2008 | Tamura et al. | |
| 7,416,177 | B2 | 8/2008 | Suzuki et al. | |
| 2003/0215275 | A1 | 11/2003 | Tamura et al. | |
| 2005/0061131 | A1 | 3/2005 | Tamura et al. | |
| 2006/0022394 | A1 | 2/2006 | Tamura et al. | |
| 2006/0261544 | A1 | 11/2006 | Tamura et al. | |
| 2007/0045919 | A1* | 3/2007 | Hayashi | 270/32 |
| 2007/0060459 | A1* | 3/2007 | Hayashi | 493/434 |
| 2007/0138726 | A1 | 6/2007 | Tamura et al. | |
| 2007/0235917 | A1 | 10/2007 | Nagasako et al. | |
| 2008/0067730 | A1 | 3/2008 | Suzuki et al. | |

(Continued)

FOREIGN PATENT DOCUMENTS

JP 2003-182928 7/2003

(Continued)

OTHER PUBLICATIONS

European Search Report dated Feb. 5, 2010.

*Primary Examiner* — Patrick Mackey
(74) *Attorney, Agent, or Firm* — Harness, Dickey & Pierce, P.L.C.

(57) ABSTRACT

A pressing unit includes a pressure roller that slides on the folded side while rotating, an elastic biasing unit that presses the pressure roller in a thickness direction of the stack of sheets, and a driving unit that slides the pressure roller in a direction substantially perpendicular to a conveying direction of the stack of sheets. A lifting unit, when the pressure roller slides to a first position, temporarily lifts up the pressure roller, and when lifted-up pressure roller slides to a second position, lifts the lifted-up pressure roller down onto the folded side.

10 Claims, 20 Drawing Sheets

U.S. PATENT DOCUMENTS

| | | | | |
|---|---|---|---|---|
| 2008/0179809 | A1 | 7/2008 | Kikkawa et al. | |
| 2008/0211162 | A1 | 9/2008 | Suzuki et al. | |
| 2008/0315488 | A1* | 12/2008 | Iguchi et al. | 270/37 |
| 2010/0119276 | A1* | 5/2010 | Sasahara et al. | 399/407 |

FOREIGN PATENT DOCUMENTS

| | | | | |
|---|---|---|---|---|
| JP | 2003182928 | A | * | 7/2003 |
| JP | 2003-341930 | | | 12/2003 |
| JP | 2003341930 | A | * | 12/2003 |

* cited by examiner

SHEET CREASER INCLUDING A CAM GUIDED PRESSING UNIT

CROSS-REFERENCE TO RELATED APPLICATIONS

The present application claims priority to and incorporates by reference the entire contents of Japanese priority document 2008-032229 filed in Japan on Feb. 13, 2008.

BACKGROUND OF THE INVENTION

1. Field of the Invention

The present invention relates to a sheet creaser, a sheet conveyer including a conveying path on which the sheet creaser is provided, a sheet finisher including the sheet creaser, an image forming apparatus including the sheet finisher or the sheet finisher.

2. Description of the Related Art

In the field of image forming apparatuses such as inkjet printers, electrophotographic copiers, facsimile machines, and multifunction products (MFPs), sheet finishers that receive a set of sheet-like recording mediums (hereinafter, "sheets") from an image forming apparatus and perform post-processing such as stapling have been widely used. With the development of multi-functional-sheet finishers, sheet finishers with both a side-stitch function and a saddle-stitch function have appeared. In most of the sheet finishers with the saddle-stitch function, a folding unit that folds the set of sheets includes at least one pair of rollers called pressure rollers and a plate member called folding plate. More particularly, the folding plate is aligned with a line to be folded of the set of sheets, and inserts the set of sheets into a nip between the pressure rollers. Thus, a crease is made along the line to be folded on the set of sheets with the nip.

Some folding units include a first pair of pressure rollers and a second pair of pressure rollers. The set of sheets is pressed twice with the first pressure rollers and the second pressure rollers, which makes a stronger crease.

However, even when the set of sheets is pressed twice, it is difficult to make a crease strong enough due to a short pressing time and a low pressing force. Because a rotation axis of the pressure rollers runs parallel to a direction perpendicular to a sheet conveying direction, a folded side of the set of sheets is pressed in the nip between the pressure rollers only for a short time. Moreover, because the pressure rollers nip the entire folded side at the same time, the pressing force on the set of sheets is distributed, i.e., the pressing force per unit area is low.

There has been disclosed a technology for making a stronger crease, in which a slide-pressing unit re-presses the folded side while sliding in a direction perpendicular to the sheet conveying direction.

Japanese Patent Application Laid-open No. 2003-341930 discloses a sheet finishing method of accumulating a plurality of sheets received from the image forming apparatus and saddle-stitching/half-folding the sheets. More particularly, after the sheets are saddle-stitched, the stitched sheets are inserted in between a pair of first pressure rollers in such a manner that a center line with respect to the sheet conveying direction is pressed by the folding plate. Thus, a crease is made on the sheets. After that, the crease is re-pressed by a second pressure roller that is sliding in the direction perpendicular to the sheet conveying direction in such a manner that a rotational axis of the second pressure roller is oblique with respect to the crease. Thus, the strong crease is made on the sheets.

In Japanese Patent Application Laid-open No. 2003-341930, a guiding member that is swinging upward guides the second pressure roller so that the second pressure roller moves up slantwise and then moves down onto the crease. The guiding member is swung by a driving force of a motor.

In a typical sheet creaser that makes the strong crease by re-pressing the folded side of the sheets with a slidable pressure roller, such as the second pressure roller disclosed in Japanese Patent Application Laid-open No. 2003-341930, sliding in the direction perpendicular to the sheet conveying direction, if the folded side of the sheets is thick, a load on the motor steeply increases when the slidable pressure roller slides up on the crease. This may results in a step-out of the motor.

In Japanese Patent Application Laid-open No. 2003-341930, the increase in load on the motor when the second pressure roller slides up on the crease is suppressed by the presence of the guiding member. However, if the size of sheets is variable, the guiding member has to move in the sheet-width direction to near the corner of the current sheets. That is, it is necessary to provide a moving space extending in the sheet-width direction. Moreover, it is necessary to provide a driving unit that moves the guiding member. This brings an increase of costs and an increase of necessary space for the driving unit. Because a typical driving unit includes a motor and a driving-force transmission mechanism, it is expected to bring a large increase in the number of parts and a large increase in the necessary space.

SUMMARY OF THE INVENTION

It is an object of the present invention to at least partially solve the problems in the conventional technology.

According to one aspect of the present invention, there is provided a sheet creaser including a pressing unit that presses a folded side of a stack of sheets folded by a folding unit, thereby making a strong crease on the stack of sheets, which includes a pressure roller that slides on the folded side while rotating, an elastic biasing unit that presses the pressure roller in a thickness direction of the stack of sheets, and a driving unit that slides the pressure roller in a direction substantially perpendicular to a conveying direction of the stack of sheets; and a lifting unit that, when the pressure roller slides to a first position, temporarily lifts up the pressure roller, and when lifted-up pressure roller slides to a second position, lifts the lifted-up pressure roller down onto the folded side. The first position and the second position are located before a corner of the folded side, whereby the pressure roller cannot slide up on the folded side.

Furthermore, according to another aspect of the present invention, there is provided a method of creasing sheets in a sheet creaser including a pressing unit that presses a folded side of a stack of sheets folded by a folding unit, thereby making a strong crease on the stack of sheets. The pressing unit includes a pressure roller that slides on the folded side while rotating, an elastic biasing unit that presses the pressure roller in a thickness direction of the stack of sheets, and a driving unit that slides the pressure roller in a direction substantially perpendicular to a conveying direction of the stack of sheets. The method includes first lifting including temporarily lifting up, when the pressure roller slides to a first position, the pressure roller; second lifting including lifting down, when lifted-up pressure roller slides to a second position, the lifted-up pressure roller onto the folded side, wherein the first position and the second position are located before a corner of the folded side, whereby the pressure roller cannot slide up on the folded side; sliding, after the pressure roller is lifted down onto the folded side, the pressure roller that is pressed by an elastic force of the elastic biasing unit back and forth along the folded side.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
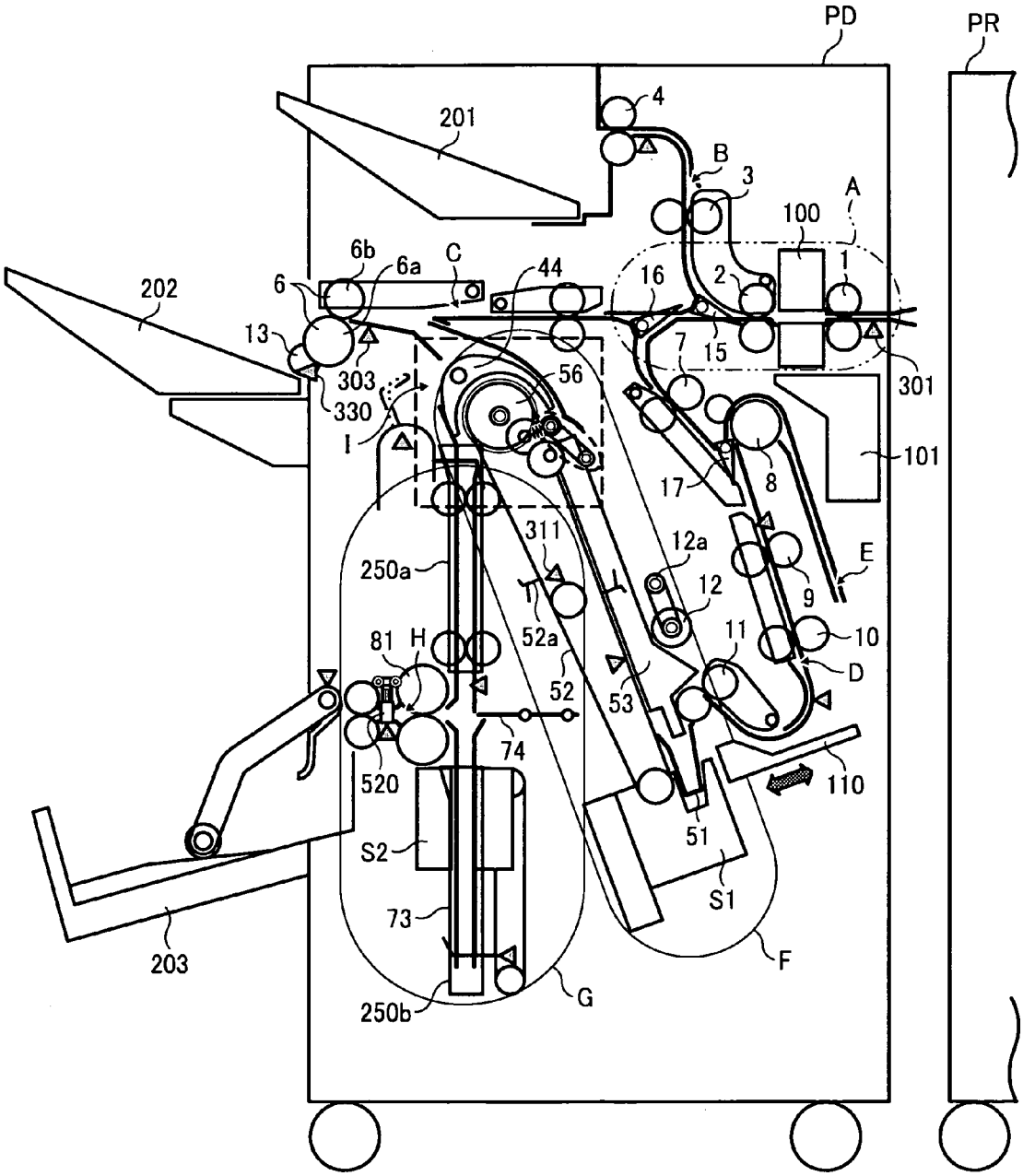
FIG. 1 is a schematic diagram of a system including a sheet finisher and an image forming apparatus according to an embodiment of the present invention.

FIG. 1 is a schematic diagram of the structure of a system including a sheet finisher PD as a sheet post-processing device and an image forming apparatus PR according to an embodiment of the present invention.

The sheet finisher PD is attached to a side of the image forming apparatus PR. A sheet ejected from the image forming apparatus PR is conveyed to the sheet finisher PD. The sheet passes through a conveyer path A for single-sheet processing (e.g., a punching unit 100 is located near the conveyer path A). After that, the sheet is conveyed by the operation of switching claws 15 and 16 to any one of a conveyer path B connecting to an upper tray 201, a conveyer path C connecting to a shift tray 202, a conveyer path D connecting to a side-stitch tray F for alignment and stapling. The image forming apparatus PR includes, although not shown in the drawings, an image processing circuit for converting received image data into printable image data, an optical writing device that writes a latent image with a light on a photosensitive element based on an image signal received from the image processing circuit, a developing device that develops the latent image to a toner image, a transferring device that transfers the toner image onto a sheet, and a fixing device that fixes the toner image on the sheet. The image forming apparatus PR sends the sheet with the fixed toner image to the sheet finisher PD. Upon receiving the sheet from the image forming apparatus PR, the sheet finisher PD performs a certain post-processing with the sheet. Although the above explanation is made assuming that the image forming apparatus PR is an electrophotographic machine, the image forming apparatus PR can be any type of image forming apparatus such as an inkjet machine or a thermal-transfer machine.

After the alignment and stapling is performed at the side-stitch tray F with the sheet that has been passed through the conveyer paths A and D, the sheet is conveyed by the operation of a guiding member 44 to either the conveyer path C connecting to the shift tray 202 or a saddle-stitch tray G for saddle-stitch and folding. If the sheet is conveyed to the saddle-stitch tray G, the sheet is folded or the like at the saddle-stitch tray G. The folded sheet is conveyed to a conveyer path H and ejected onto a lower tray 203. The conveyer path D is provided with a switching claw 17 that keeps a position as shown in FIG. 1 by support of a low load spring (not shown). After the back end of the sheet passes the switching claw 17 while the sheet is conveyed by rotation of a pair of conveyer rollers 7, the sheet is reversed along a turn guiding member 8 by reverse-rotation of a pair of conveyer rollers 9, in some cases, together with reverse-rotation of at least one of a pair of conveyer rollers 10 and a pair of stapled-sheet conveyer rollers 11 (brush rollers). Thus, the sheet is conveyed with the back end ahead to a sheet accommodating unit E for pre-stacking. When the next sheet is conveyed to the sheet accommodating unit E, the two sheets are conveyed out of the sheet accommodating unit E overlapped with each other. It is possible to convey three or more sheets overlapped with one another by repeating those operations.

An entrance sensor 301 that detects the sheet coming from the image forming apparatus PR, a pair of entrance rollers 1, the punching unit 100, a punch-waste hopper 101, a pair of conveyer rollers 2, and the switching claws 15 and 16 are arranged near the conveyer path A in this order, with the entrance sensor 301 being closest to the image forming apparatus PR. The switching claws 15 and 16 keep positions as shown in FIG. 1 by support of springs (not shown). When corresponding solenoids (not shown) are turned ON, the switching claws 15 and 16 switch ON. The sheet is conveyed to one of the conveyer paths B, C, and D depending on a switching pattern of the switching claws 15 and 16.

When the sheet is to be conveyed to the conveyer path B, the solenoids are kept OFF, and thereby the switching claws 15 and 16 are in the positions shown in FIG. 1. As a result, the sheet is conveyed to the shift tray 202 though a pair of conveyer rollers 3 and a pair of ejection rollers 4. When the sheet is to be conveyed to the conveyer path C, the both solenoids are turned ON so that the switching claw 15 turns upward and the switching claw 16 turns downward. Thus, the sheet is conveyed to the shift tray 202 through a pair of ejection rollers 6. When the sheet is to be conveyed to the conveyer path D, the solenoid for the switching claw 16 is turned OFF and the solenoid for the switching claw 15 is turned ON so that the switching claw 15 turns upward and the switching claw 16 turned downward.

Figure 15A:
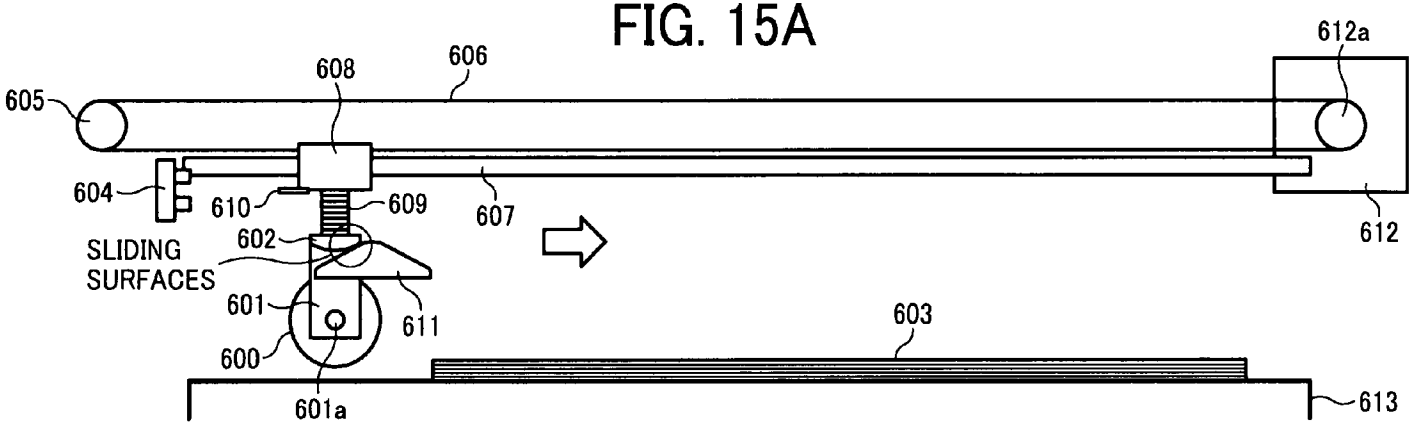
FIGS. 15A and 15B are schematic diagrams for explaining operations of the slide-pressing mechanism, depicting a state where a first guiding member that is attached to the slidable pressure roller slides up on a second guiding member.
Figure 15B:
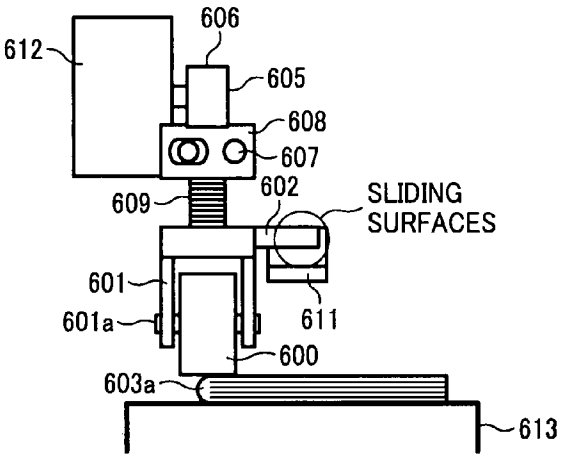

The sheet finisher PD can perform various sheet processing including punching using the punching unit 100, alignment and side stitch using a pair of jogger fences 53 and a side-stitch stapler S1, alignment and saddle stitch using an upper saddle-stitch jogger fence 250*a*, a lower saddle-stitch jogger fence 250*b*, and a saddle-stitch stapler S2, sorting using the shift tray 202, half-folding using a folding plate 74 and a pair of first pressure rollers 81. Moreover, the sheet finisher PD can perform slide-pressing using a slide-pressing unit 525 (see FIG. 15) as a subsequent process of the half-folding to make a crease on the folded stack of sheets stronger.

As show in FIG. 1, a sheet ejecting unit that ejects the sheets on the shift tray 202 includes the ejection rollers 6 (6*a*, 6*b*), a reverse roller 13, a sheet sensor 330, the shift tray 202, a shifting mechanism that shifts the shift tray 202 back and forth in a direction perpendicular to the sheet conveying direction, and a lifting mechanism that lifts the shift tray 202 up and down.

The reverse roller 13 is made of sponge. When the sheet is ejected by the ejection rollers 6, the reverse roller 13 comes in contact with the sheet so that the back end of the sheet abuts against an end fence, which makes the sheets stacked on the shift tray 202 aligned. The reverse roller 13 rotates by the rotation of the ejection rollers 6. There is a lift-up stop switch (not shown) near the reverse roller 13. When the shift tray 202 lifts up and pushes the reverse roller 13 up, the lift-up stop switch turns ON and a shift-tray lifting motor (not shown) stops. Thus, the shift tray 202 cannot move up beyond a predetermined position.

The sheet sensor 330 is arranged near the reverse roller 13. The sheet sensor 330 detects a position of the top one out of sheets stacked on the shift tray 202. When it is determined using the sheet sensor 330 that the position of the top sheet reaches a predetermined height, the shift tray 202 moves down by a predetermined amount by the action of the shift-tray lifting motor so that the position of the top sheet is always at the same level.

The ejection rollers 6 are formed with a driving roller 6*a* and a driven roller 6*b*. The driven roller 6*b* is arranged upstream of the driving roller 6*a*, and is rotatably attached to a free end of an open/close guiding plate. The open/close guiding plate is attached to the sheet finisher PD rotatably around the other end, arranged with the free end being closer to the shift tray 202. The driven roller 6*b* comes in contact with the driving roller 6*a* under the weight of the driven roller 6*b* or by a biasing force, and the sheet is ejected through between the driving roller 6*a* and the driven roller 6*b*. When stapled sheets are to be ejected, the open/close guiding plate moves up to a predetermined position, and then moves down at predetermined timing decided based on a detection signal from an ejection sensor 303. The predetermined position is decided based on a detection signal from a guiding-plate open/close sensor (not shown). The open/close guiding plate moves up, driven by a guiding-plate open/close motor (not shown).

When the sheet is conveyed to the side-stitch tray F by the rotation of the stapled-sheet conveyer rollers 11, the sheet is stacked on the side-stitch tray F. More particularly, the sheet goes backward by rotation of a reverse roller 12 in the vertical direction (i.e., the sheet conveying direction), and abut against an end fence 51, which makes the sheets stacked on the side-stitch tray F aligned. A direction perpendicular to the sheet conveying direction (i.e., the sheet-width direction) is aligned with the jogger fences 53. When it is determined based on a staple signal from a control circuit 350 that a last one of a set of sheets is stacked on the side-stitch tray F, the side-stitch stapler S1 stapes the set of sheets. A sheet pressing member 110 presses a side of the set of sheets when the side-stitch stapler S1 staples the sheets.

A home position (HP) of a lifting claw 52*a* is detected with an ejection-belt HP sensor 311. The ejection-belt HP sensor 311 turns ON/OFF by operation of the lifting claw 52*a* attached to a lifting belt 52. Two lifting claws 52*a* are attached to an outer surface of the lifting belt 52, with the lifting claws 52*a* being opposed to each other. The two lifting claws 52*a* alternately lift the set of sheets out of the side-stitch tray F.

The lifting belt 52 rotates between a driving pulley and a driven pulley along a center line of the aligned sheet width. A plurality of lifting rollers 56 are attached rotatably to a driving shaft, working as driven rollers. The lifting rollers 56 are arranged symmetric to each other with respect to the lifting belt 52.

The reverse roller 12 swings around a fulcrum 12*a* by a tapping solenoid, which causes the back end of the sheets stacked on the side-stitch tray F to abut against the end fence 51. The reverse roller 12 rotates counterclockwise. The pair of jogger fences 53 is arranged so that both width-direction sides of the stacked sheets put between them. The jogger fences 53 slide in the sheet-width direction back and forth via a timing belt (not shown) by positive-driving or negative-driving of a jogger motor (not shown). The side-stitch stapler S1 moves to a target position in the sheet-width direction via a timing belt (not shown) by positive-driving or negative-driving of a stapler moving motor (not shown) to staple the target position of the sheet side.

A saddle-stitch mechanism related to the slide-pressing process is explained below. A side-stitch mechanism is not explained, because the side-stitch mechanism is not a feature of the sheet finisher PD.

Figure 2:
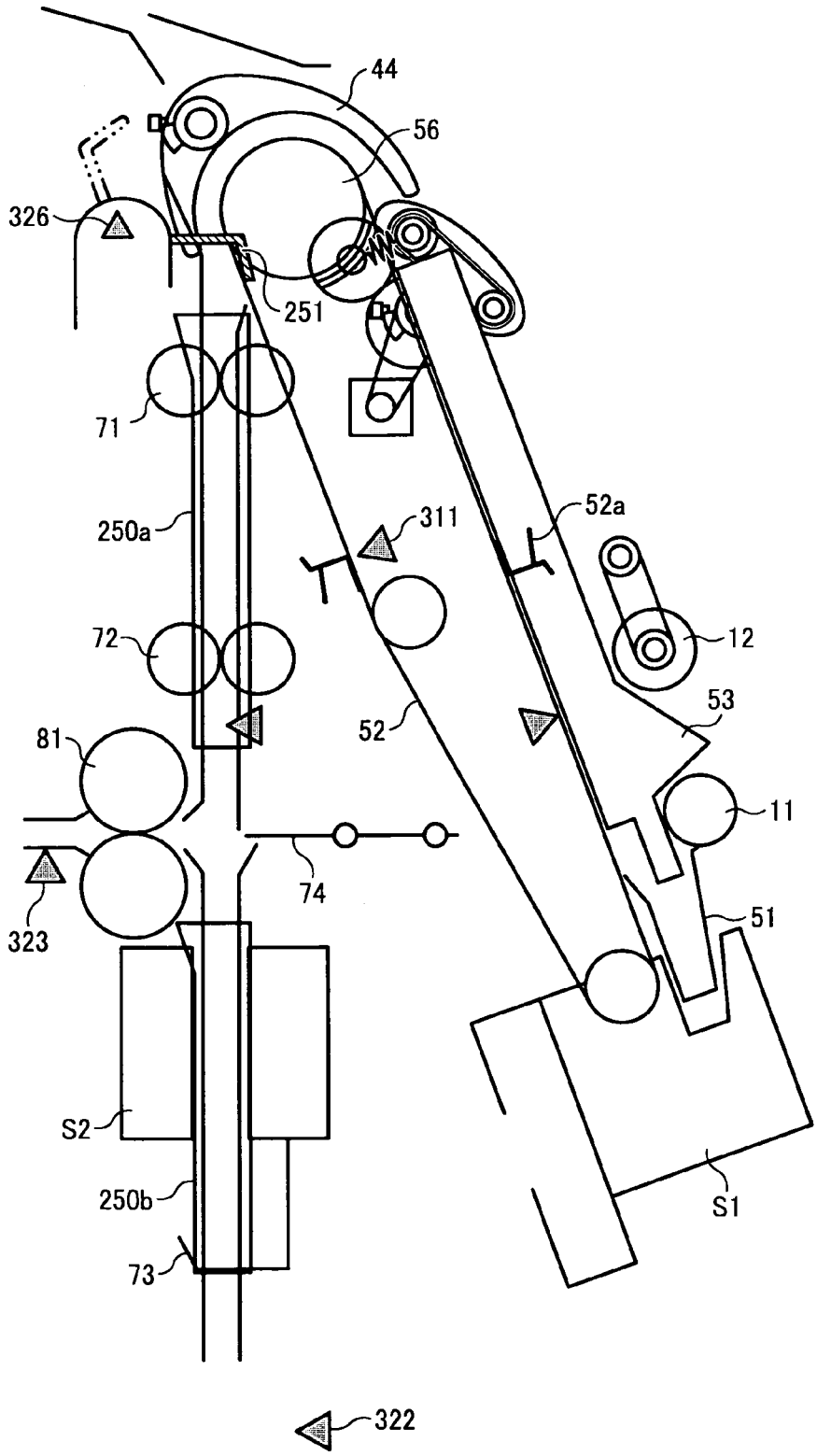
FIG. 2 is a schematic diagram of a side-stitch tray and a saddle-stitch tray shown in FIG. 1, viewed from the front side of the sheet finisher.
Figure 3:
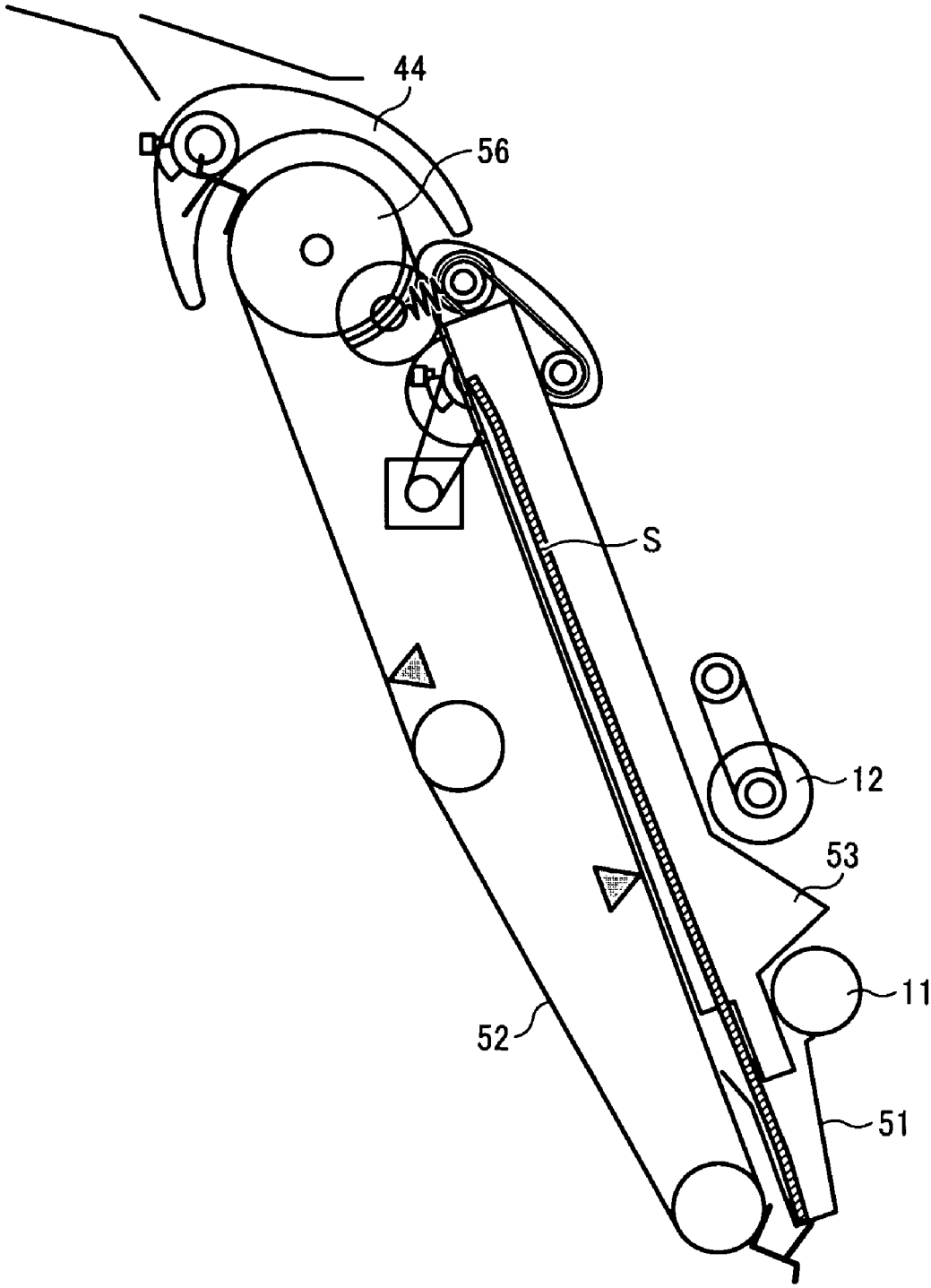
FIGS. 3 to 10 are schematic diagrams for explaining operations in a saddle-stitch mode according to the embodiment.

FIG. 2 is a schematic diagram of the side-stitch tray F and the saddle-stitch tray G viewed from the front side of the sheet finisher PD. FIGS. 3 to 10 are schematic diagrams for explaining operations in a saddle-stitch mode.

It is assumed that the sheet is conveyed to the conveyer path D by the operation of the switching claws 15 and 16, and then is conveyed to the side-stitch tray F by the operation of the conveyer rollers 7, 9, and 10, and the stapled-sheet conveyer rollers 11. At the side-stitch tray F, the sheet is aligned with the stapled-sheet conveyer rollers 11 both in the saddle-stitch mode and the side-stitch mode (see FIG. 3). In other words, the operations in the saddle-stitch mode and the stapling mode are same before a set of sheets is stapled in the side-stitch mode.

Figure 4:
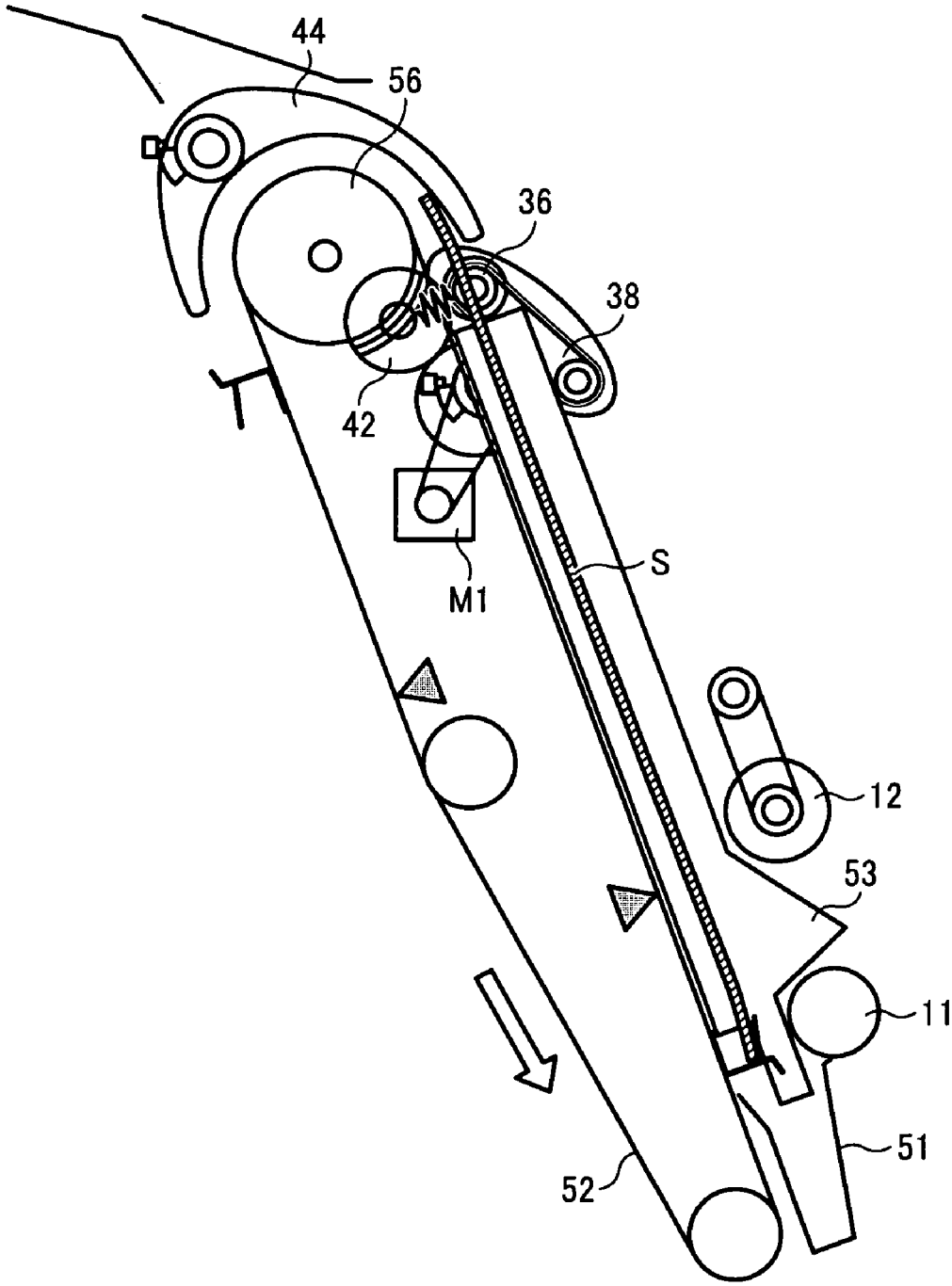
Figure 5:
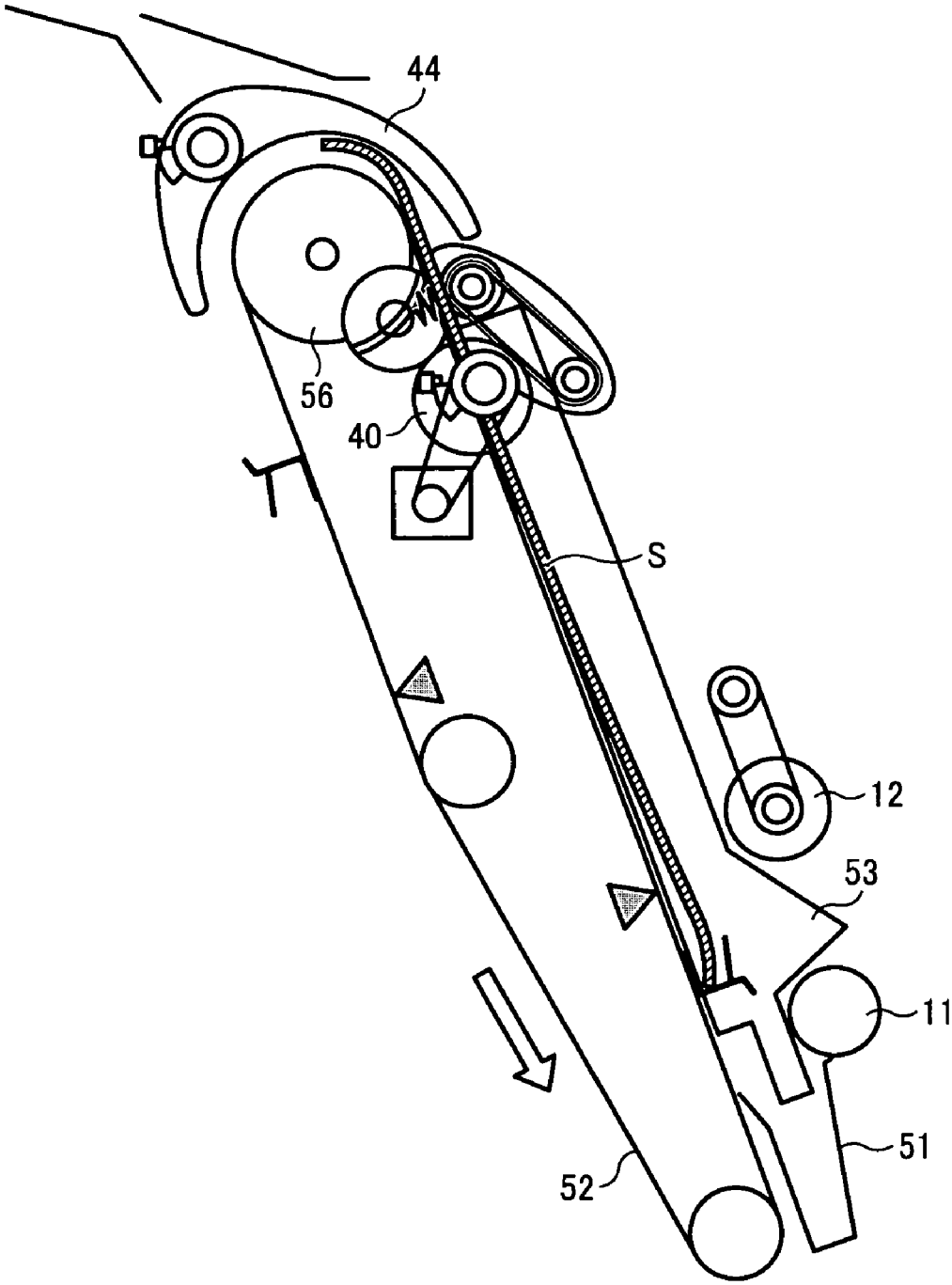

After a set of sheets (hereinafter, "stack of sheets 603") is roughly aligned at the side-stitch tray F, the stack of sheets 603 is lifted up with the lifting claw 52*a*. As shown in FIG. 4, a front end of the stack of sheets 603 is conveyed to a position between an inner circumference of the guiding member 44 and the lifting rollers 56, passed between a roller 36 and a driven roller 42 that are in an open position in which a distance between the roller 36 and the driven roller 42 is wider than a thick of the stack of sheets 603. After that, the roller 36 swings to a close position by a motor M1 and a cam 40, and the stack of sheets 603 is nipped by the roller 36 and the driven roller 42 with a predetermined pressure. The stack of sheets 603 is then conveyed to the saddle-stitch tray G by the rotation of the roller 36 and the lifting rollers 56 as shown in FIG. 5. The roller 36 rotates by a timing belt 38. The lifting rollers 56 that are attached to the driving shaft of the lifting belt 52 rotate in synchronization with the lifting belt 52.

Figure 6:
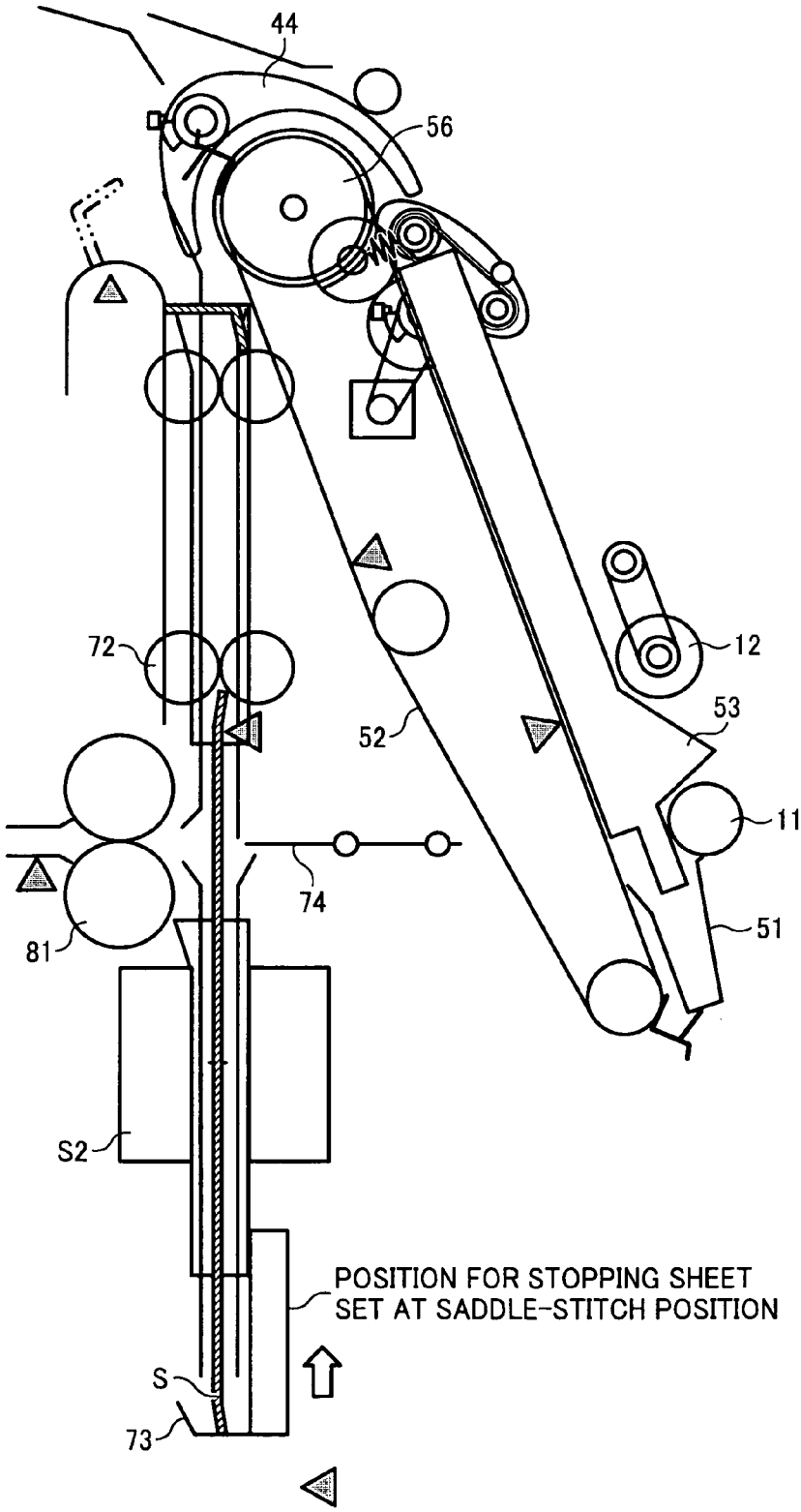
Figure 7:
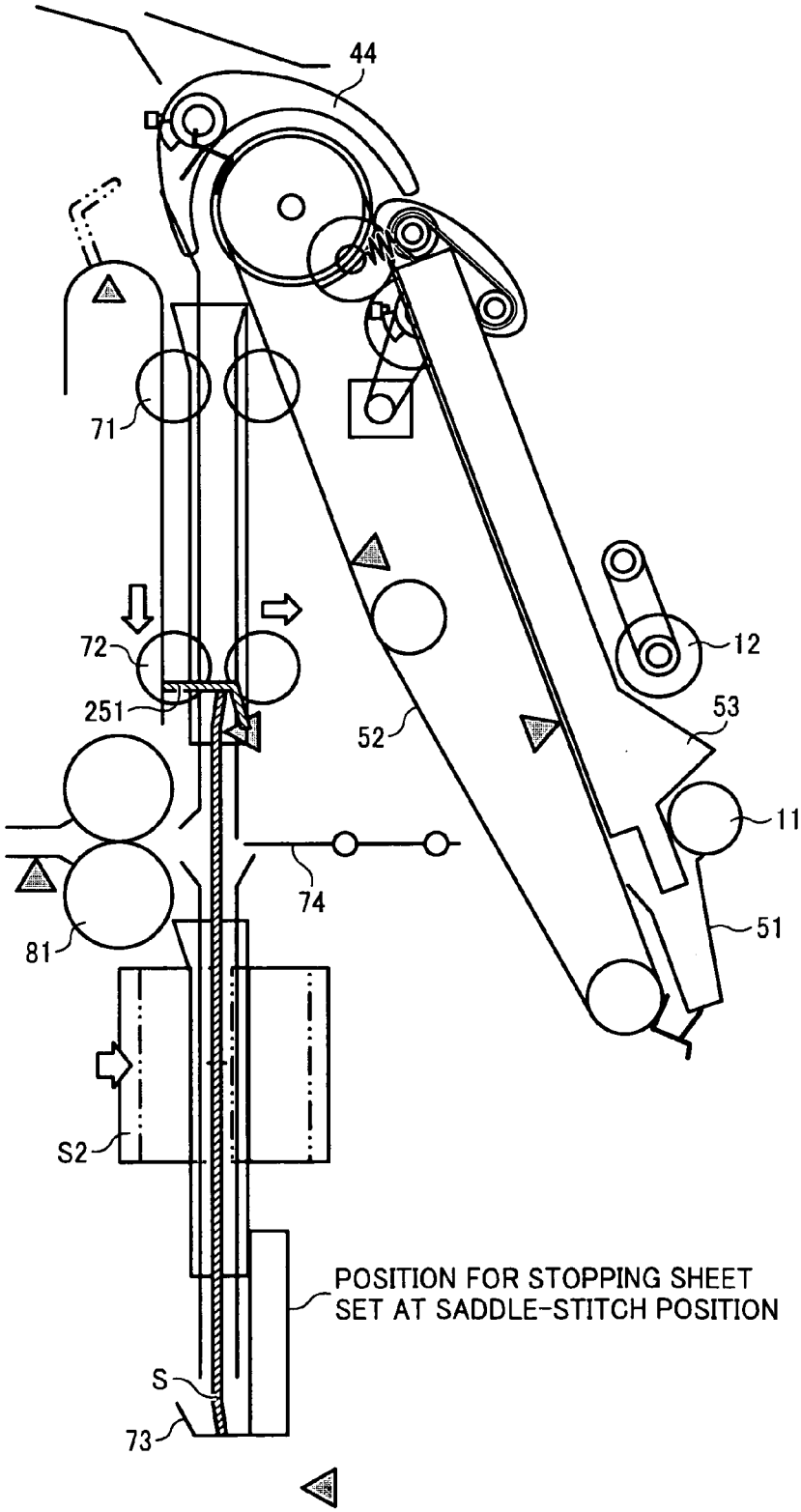

In the saddle-stitch tray G, the stack of sheets 603 is conveyed with a pair of upper conveyer rollers 71 and a pair of lower conveyer rollers 72 (72*a*, 72*b*) to a position at which the front end of the stack of sheets 603 abuts against a movable backend fence 73 as shown in FIG. 6. The position of the movable backend fence 73 depends on a length of the sheets. When the front end of the stack of sheets 603 abuts against the movable backend fence 73, the lower conveyer rollers 72 apart from each other and a back end of the stack of sheets 603 is tapped with a tapping claw 251 as shown in FIG. 7. Thus, the stack of sheets 603 is finely aligned with respect to the sheet conveying direction. In this manner, even when the alignment of the stack of sheets 603 breaks during the travel from the side-stitch tray F to the movable backend fence 73, the tapping with the tapping claw 251 makes the stack of sheets 603 aligned.

The stack of sheets 603, the movable backend fence 73, and the relative members shown in FIG. 7 are in saddle-stitch positions. The stack of sheets 603 is aligned with respect to its width with the upper saddle-stitch jogger fence 250*a* and the lower saddle-stitch jogger fence 250*b*. The saddle-stitch stapler S2 staples a center position of the aligned stack of sheets 603. It is noted that the position of the movable backend fence 73 is decided based on a pulse from a backend-fence HP sensor 322, and the position of the tapping claw 251 is decided based on a pulse from a tapping-claw HP sensor 326.

Figure 8:
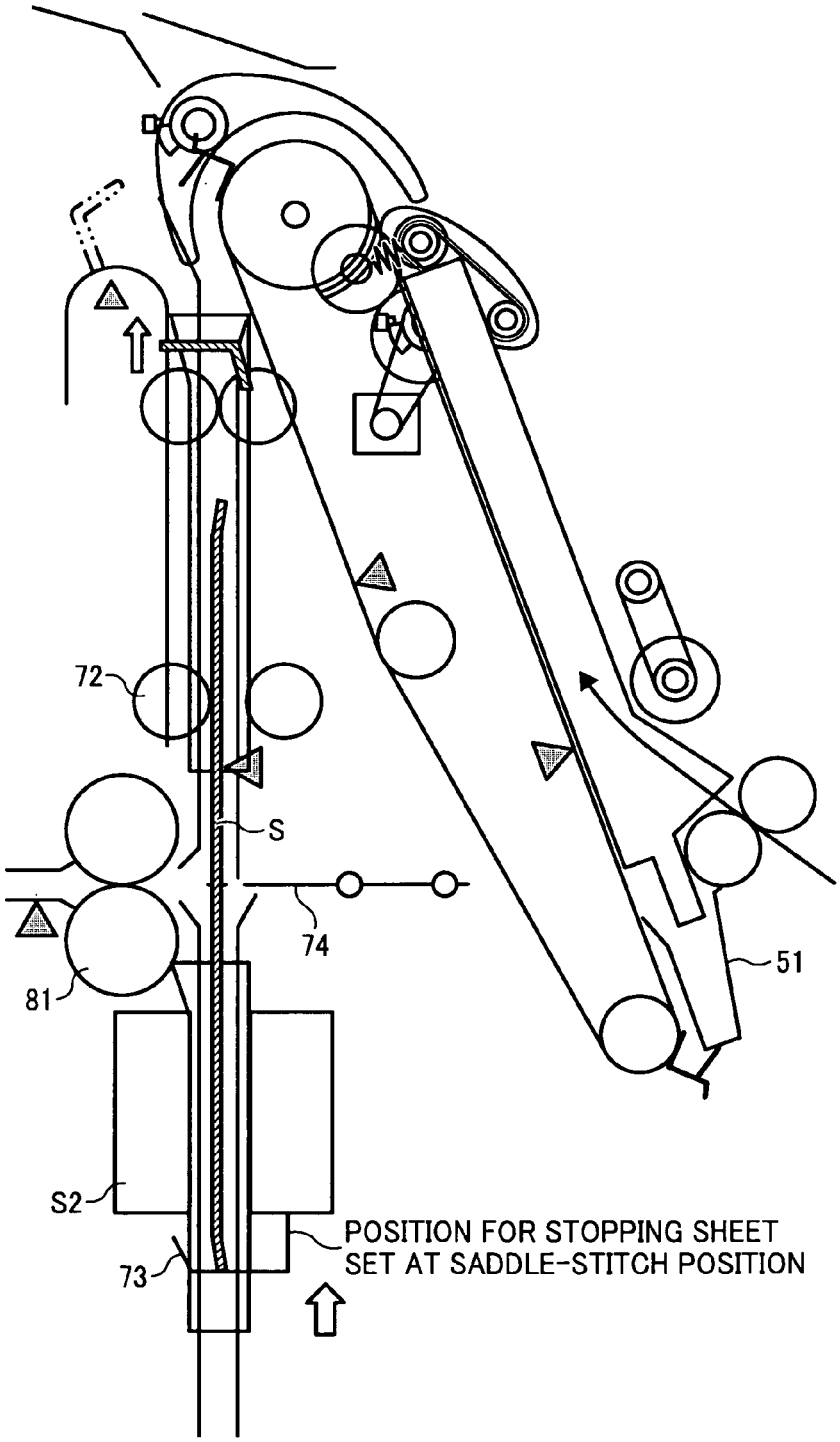

As shown in FIG. 8, while the lower conveyer rollers 72 apart from each other, the movable backend fence 73 lifts the stapled stack of sheets 603 up to a position so that the center position, i.e., the stapled position is aligned with the folding plate 74. After that, the folding plate 74 inserts the center position into between the rotating first pressure rollers 81 by pressing the center position in a direction perpendicular to the surface of the stack of sheets 603. The rotating first pressure rollers 81 nip the stack of sheets 603, and convey the stack of sheets 603 with a pressure. Thus, a crease is made on the center of the stack of sheets 603. In this manner, the stapled stack of sheets 603 is lifted up to the position for folding without fails only by the movement of the movable backend fence 73.

Figure 10:
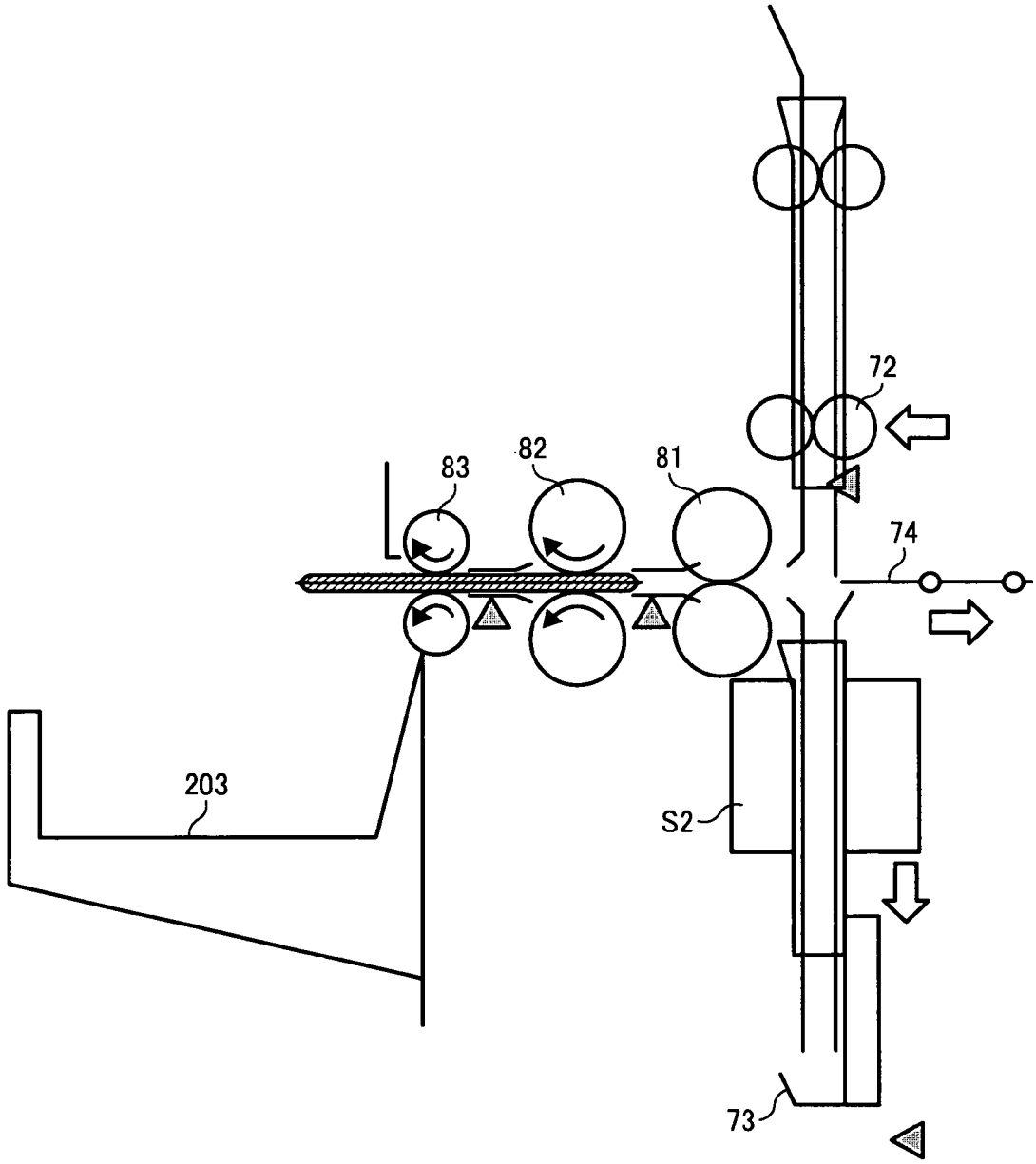

As shown in FIG. 10, the crease of the folded stack of sheets 603 is made stronger, re-pressed by a pair of second pressure rollers 82. The re-pressed stack of sheets 603 is ejected onto the lower tray 203 via a pair of ejection rollers 83. When it is determined using an upstream sheet sensor 323 that the back end of the stack of sheets 603 has been passed through the upstream sheet sensor 323, those members of the saddle-stitch tray G prepare for the next saddle stitch, more particularly, the folding plate 74 and the movable backend fence 73 return to the HPs and the lower conveyer rollers 72 return to a nip position for forming the nip. If a sheet size and number of sheets of the next set of sheets are same as the stack of sheets 603, the movable backend fence 73 may move directly to the position shown in FIG. 2 instead of the HP. Whether the stack of sheets 603 is stacked on the lower tray 203 is determined based on the position of the back end of the stack of sheets 603 detected using a downstream sheet sensor 324. The second pressure rollers 82 are not shown in FIG. 1. It is possible to design, based on its design conditions, the sheet creaser without provided with the second pressure rollers 82.

Figure 9:
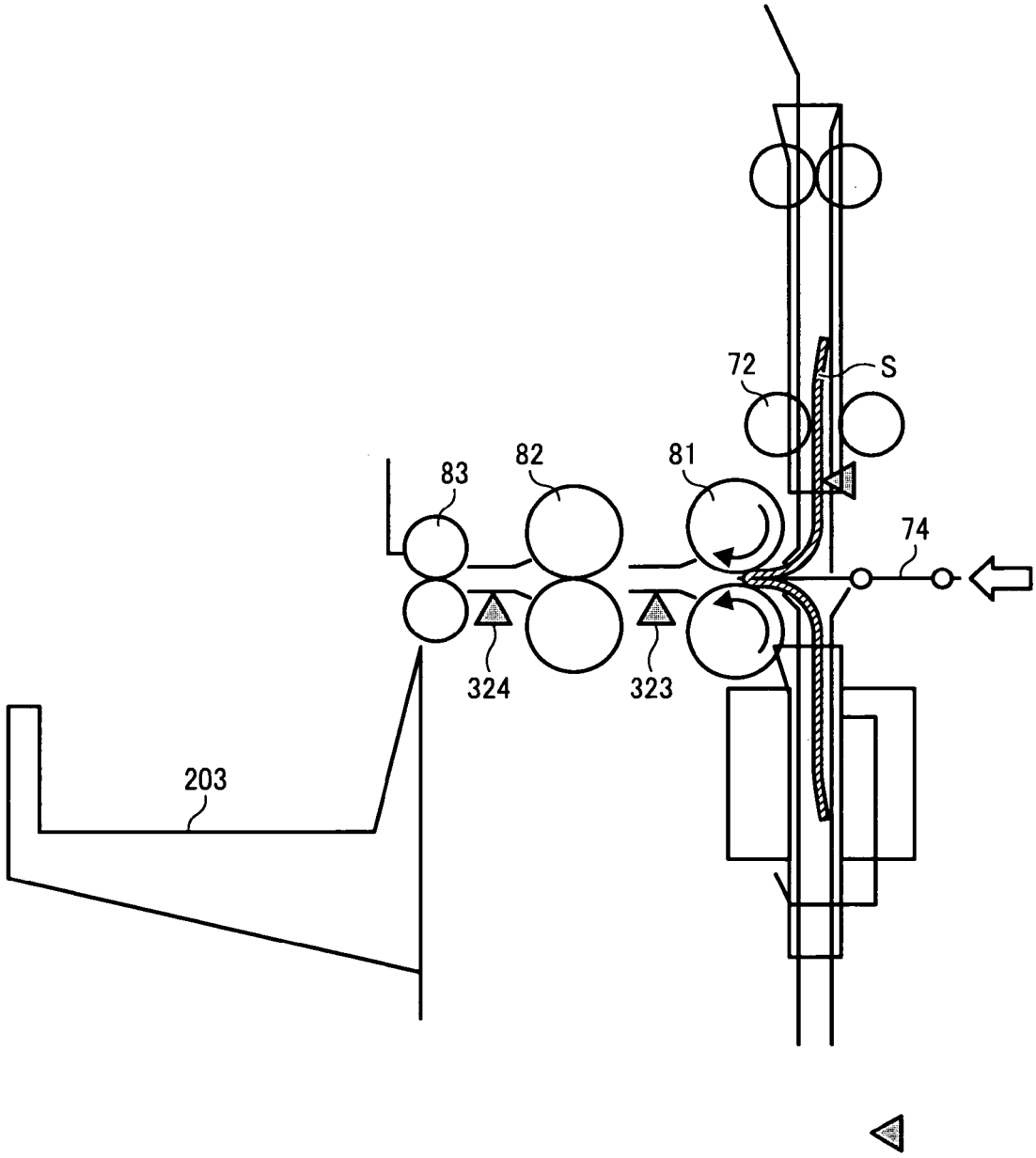

A slidable pressure roller 600 and a mechanism for driving the slidable pressure roller 600 are not shown in FIGS. 9 and 10. Those units will be described with reference to FIG. 12 and the subsequent drawings.

Figure 11:
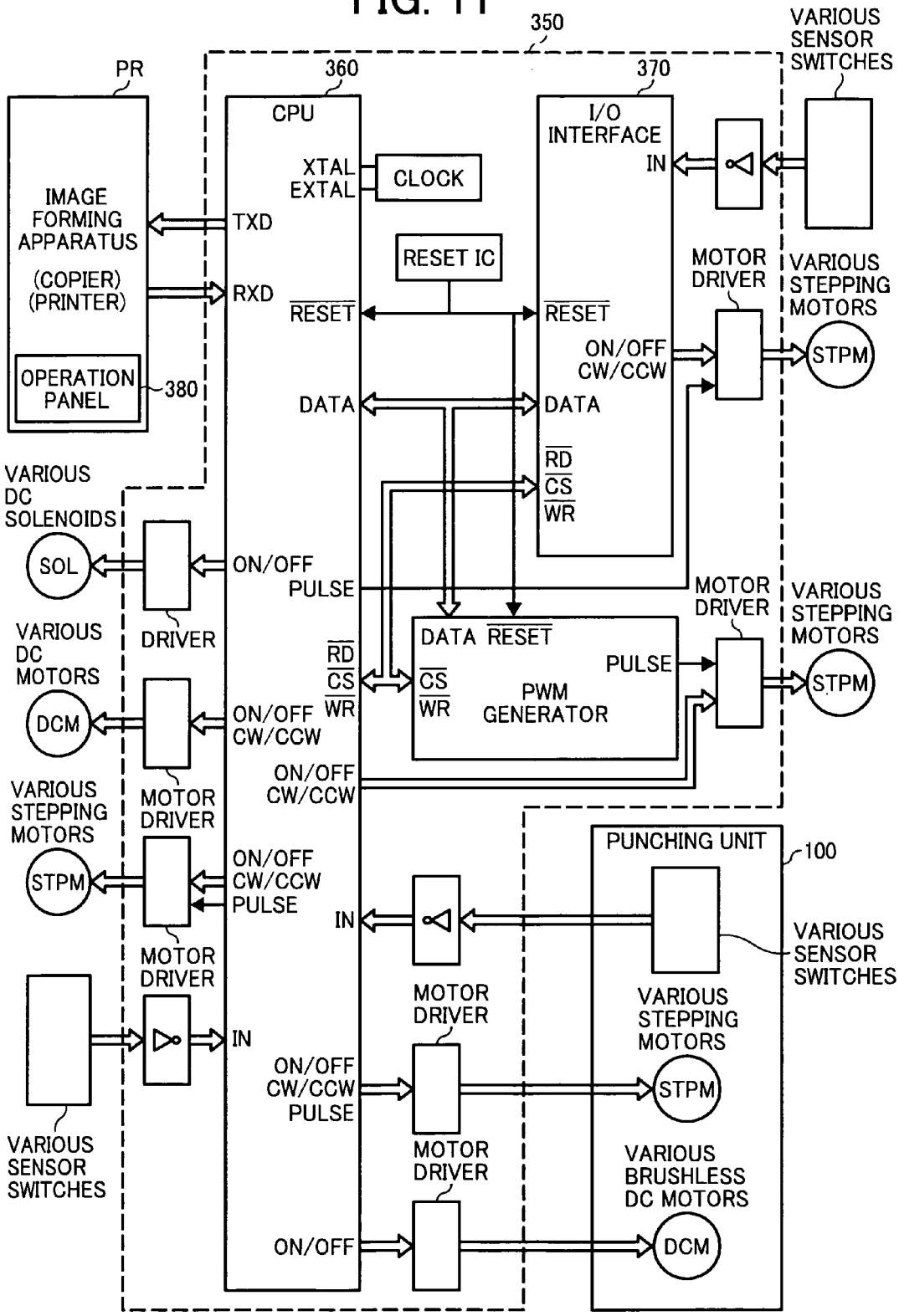
FIG. 11 is a block diagram of the control structure of the system according to the embodiment.

FIG. 11 is a block diagram of the control structure of the system according to the embodiment. The control circuit 350 that controls the sheet finisher PD can be a micro computer, including a central processing unit (CPU) 360 and an input/output (I/O) interface 370. The CPU 360 receives via the I/O interface 370 various signals from various switches on an operation panel 380 of the image forming apparatus PR and from various sensors such as the sheet sensor 330. The CPU 360 controls, based on the received signals, various components including the motor that lifts up/down the shift tray 202, the motor that opens/closes the open/close guiding plate, the motor that shifts the shift tray 202, the motor that drives the reverse roller 12, various solenoids including the tapping solenoid, the motors that drive various conveyer rollers, the motors that drive various ejection rollers, the motor that drives the lifting belt 52, the motor that moves the side-stitch stapler S1, the motor that rotates the side-stitch stapler S1 to a slant position, the motor that moves the jogger fences 53, the motor that swings the guiding member 44, the motor that drives the lifting rollers 56, the motor that moves the movable backend fence 73, the motor that moves the folding plate 74, the motor that drives the first pressure rollers 81. The motor that drives the stapled-sheet conveyer rollers 11 sends a pulse signal to the CPU 360. Upon receiving the pulse signal, the CPU 360 counts the received pulse signal and controls a solenoid 170 (not shown) and a jogger motor 158 (not shown) based on a result of count.

The CPU 360 controls those components by reading program codes from a read only memory (ROM) (not shown), loading the program codes on a work area of a random access memory (RAM) (not shown), and executing the loaded program codes.

Figure 12:
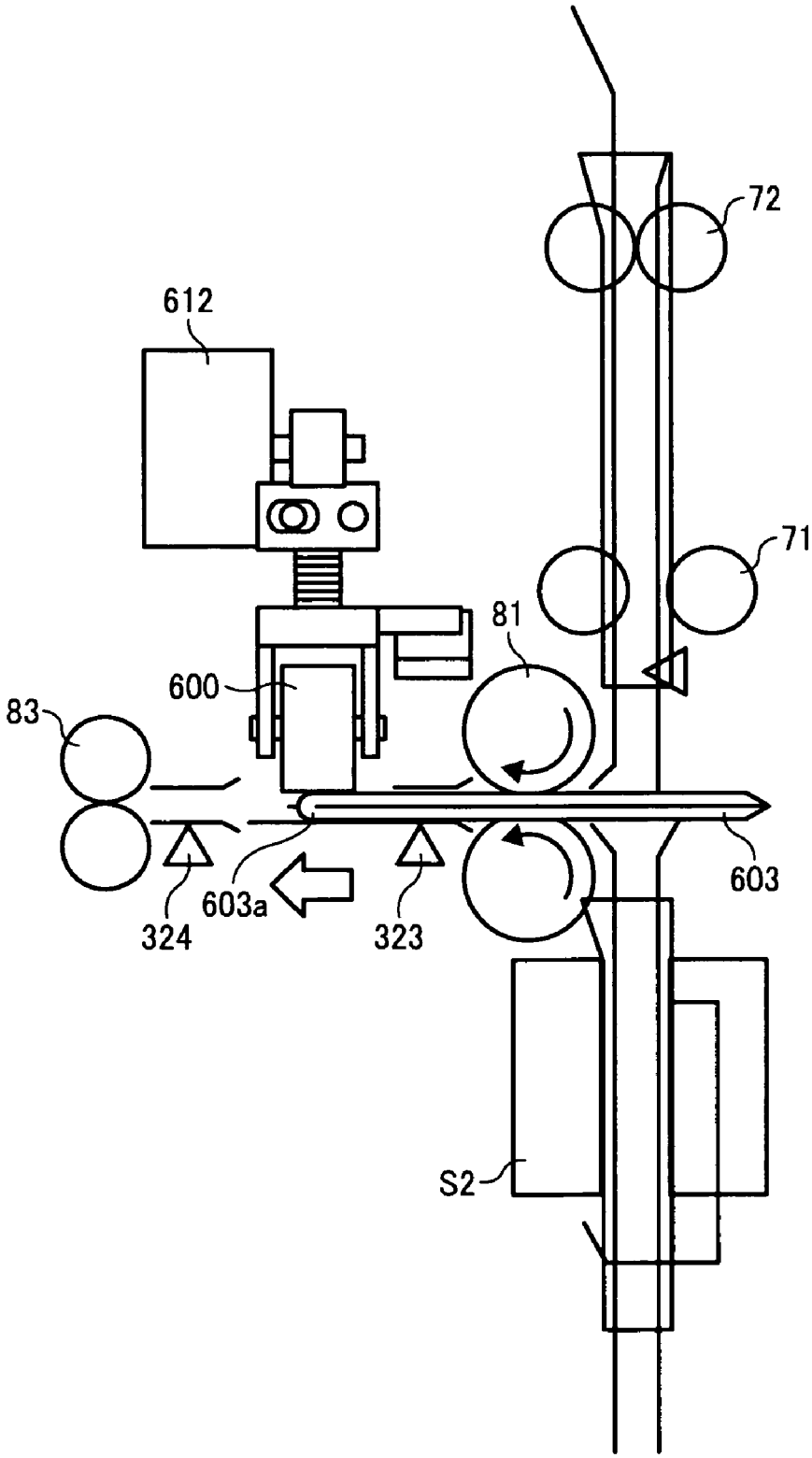
FIG. 12 is a schematic diagram for explaining a slide-pressing process in which a slidable pressure roller slide-presses a folded side of a stack of sheets, depicting a state where the rotating slidable pressure roller is sliding on the folded side.
Figure 13:
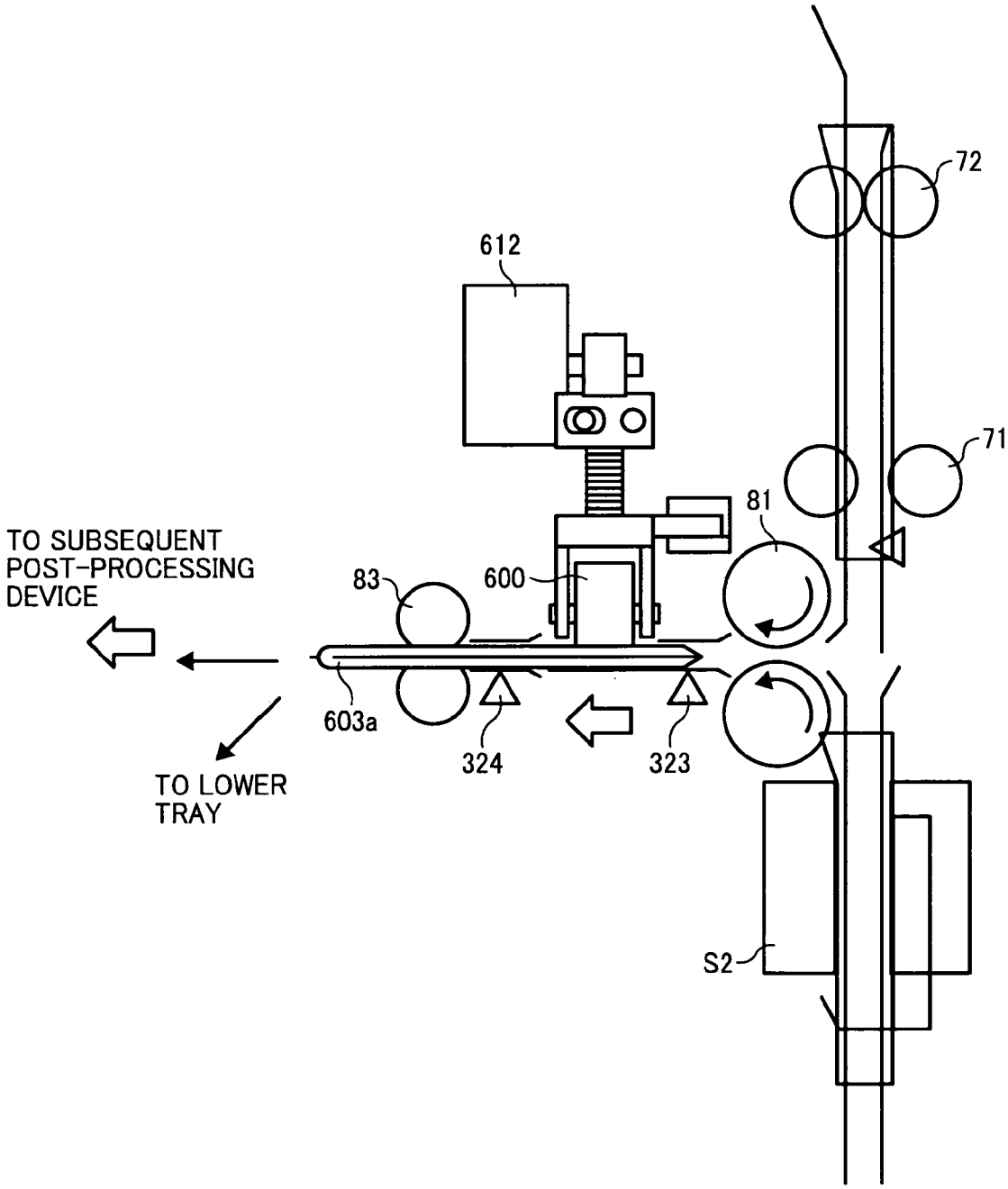
FIG. 13 is a schematic diagram for explaining the slide-pressing process, depicting a state where the stack of sheets is ejected at the end of the slide-pressing process.

FIGS. 12 and 13 are schematic diagrams for explaining a slide-pressing process performed by the slidable pressure roller 600. The slidable pressure roller 600 is located adjacent to a downstream side of the first pressure rollers 81 in the sheet conveying direction. The slidable pressure roller 600 slides in a direction perpendicular to the sheet conveying direction. As shown in FIG. 12, after the stack of sheets 603 is folded by the first pressure rollers 81, the stack of sheets 603 is conveyed in the sheet conveying direction indicated by an arrow. The stack of sheets 603 is stopped, under constant pulse control, when a predetermined time has passed since the front end of the stack of sheets 603 passes the upstream sheet sensor 323. Meanwhile, the motor that drives the first pressure rollers 81 is a stepping motor. The stack of sheets 603 is stopped so that the front end is on a sliding area of the slidable pressure roller 600. After that, a folded side 603*a* (i.e., the front end) is slide-pressed by the sliding slidable pressure roller 600, and thus the strong crease is made. After the slide-pressing, the stack of sheets 603 is conveyed in the sheet conveying direction indicated by an arrow shown in FIG. 13.

Figure 14A:
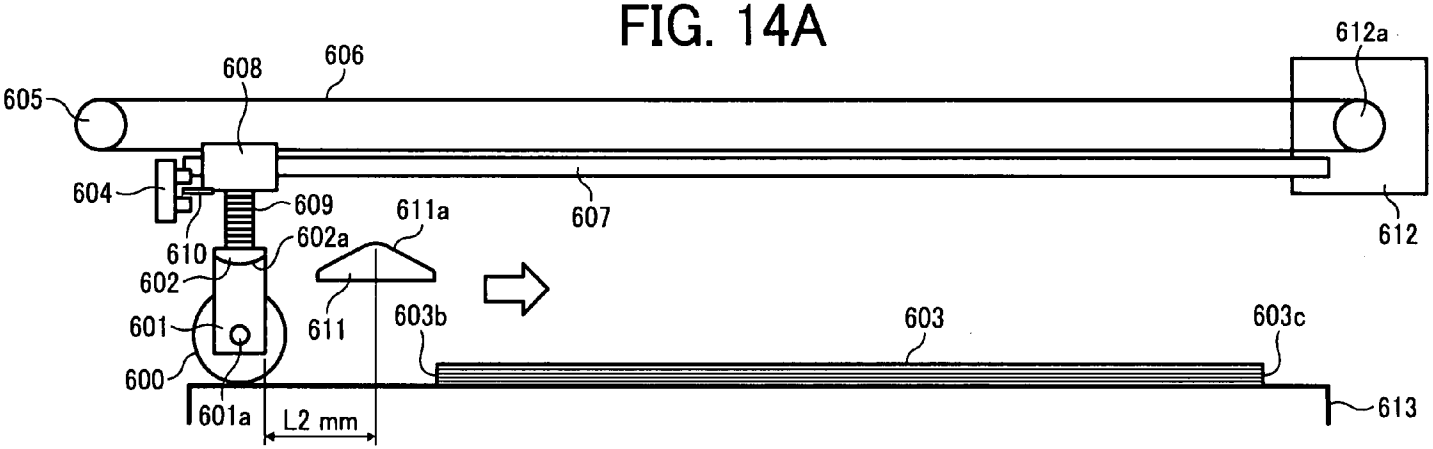
FIGS. 14A and 14B are schematic diagrams for explaining operations of a slide-pressing mechanism, depicting a state where the slidable pressure roller is at its HP.
Figure 14B:
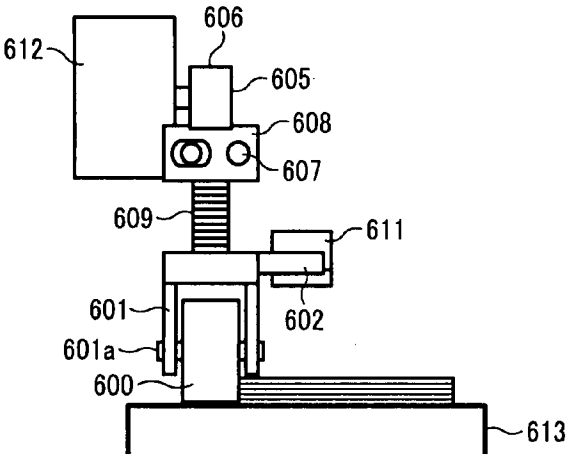

FIG. 14A is a schematic diagram of a slide-pressing mechanism viewed along the sheet conveying direction; and FIG. 14B is a schematic diagram of the slide-pressing mechanism viewed from the left side of the stack of sheets 603 across the sheet conveying direction. FIGS. 14 to 17 are schematic diagrams for explaining operations of the slide-pressing mechanism. FIGS. 14A and 14B depict a state where the slide-pressing operation starts. As shown in FIGS. 14A and 14B, the slide-pressing mechanism includes a mechanism for driving the slidable pressure roller 600 (hereinafter, "slide mechanism") and a mechanism for driving a second guiding member 611 (hereinafter, "guide mechanism").

The slide mechanism includes a holder 601, a first guiding member 602, a spring 609, a first slider 608, a first sliding shaft 607, a first stepping motor 612, a first pulley 605, and a first timing belt 606.

The slidable pressure roller 600 is fit in the holder 601 in such a manner the slidable pressure roller 600 is rotatably attached to a spindle 601*a* of the holder 601. Thus, the slidable pressure roller 600 slides while rotating. The first guiding member 602 is attached, as a projection, to a side face of the holder 601 that faces opposite to the sheet conveying direction. The holder 601 is suspended from the first slider 608 via a shaft. Due to an elastic force of the spring 609 between the holder 601 and the first slider 608, the holder 601 is movable up and down. The spring 609 is a so-called compression spring. The holder 601 and the slidable pressure roller 600 are always pressed against a guiding plate 613 that forms a part of the sheet conveyer path by the elastic force of the spring 609.

The first slider 608 is slidably attached to the first sliding shaft 607 to slide in the direction perpendicular to the sheet conveying direction. The first slider 608 is fixed to the first timing belt 606 that is located above the first sliding shaft 607. The first timing belt 606 is stretched between a pulley 612*a* and the first pulley 605. The pulley 612*a* is a driving pulley and the first pulley 605 is a driven pulley. The pulley 612*a* is provided to a driving shaft of the first stepping motor 612. With this configuration, the first slider 608 slides back and forth along the first sliding shaft 607 by the rotation of the first timing belt 606.

A first light sensor 604 is provided near an end of the first sliding shaft 607. Assume now that the first light sensor 604 is provided near the end of the first sliding shaft 607 close to the first pulley 605 as shown in FIG. 14A. A shielding plate 610 is attached to the first slider 608 so that the shielding plate 610 shields the first light sensor 604 when the first slider 608 is in the HP. Thus, the first light sensor 604 detects whether the first slider 608 is in the HP. In other words, the HP of the slidable pressure roller 600 is a position where the shielding plate 610 that is attached to the first slider 608 as a projection shields the first light sensor 604. Motion of the slidable pressure roller 600 is controlled by a driving pulse of the first stepping motor 612 by referring to a distance from the HP. Therefore, various patterns of motion can be made in consideration of the variable sheet width.

Figure 18A:
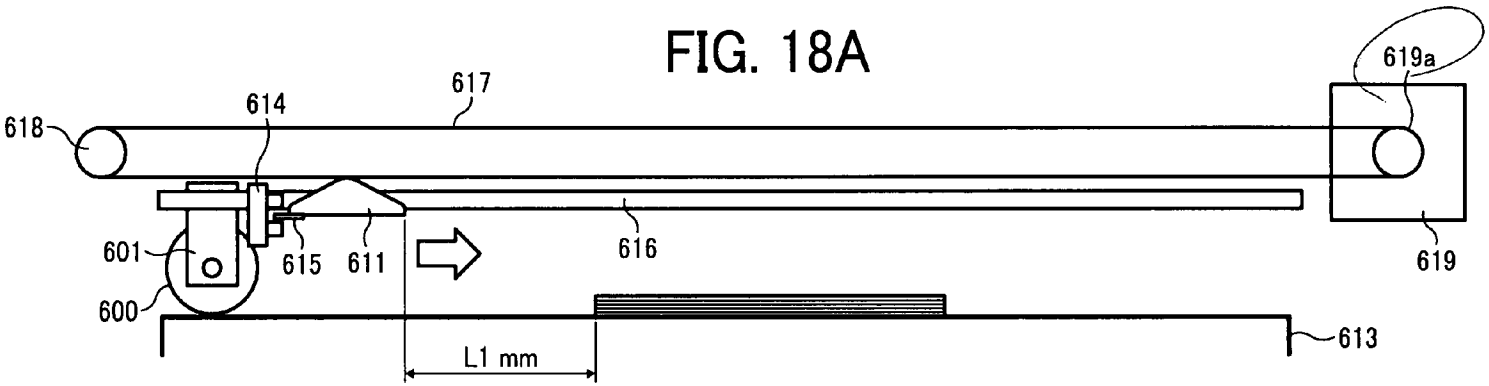
FIGS. 18A and 18B are schematic diagrams of a guide mechanism for explaining its operations, depicting a state where the second guiding member is at its HP.
Figure 18B:
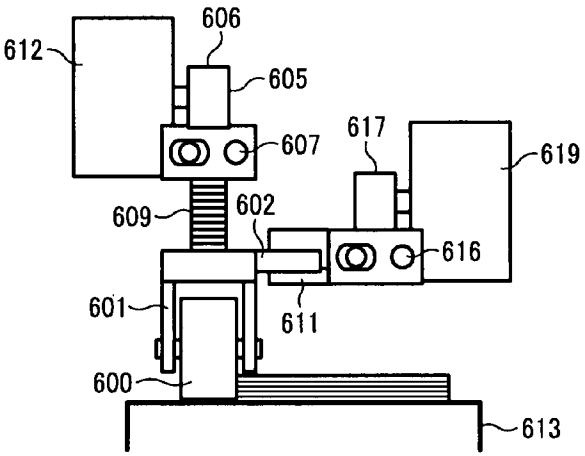
Figure 19:
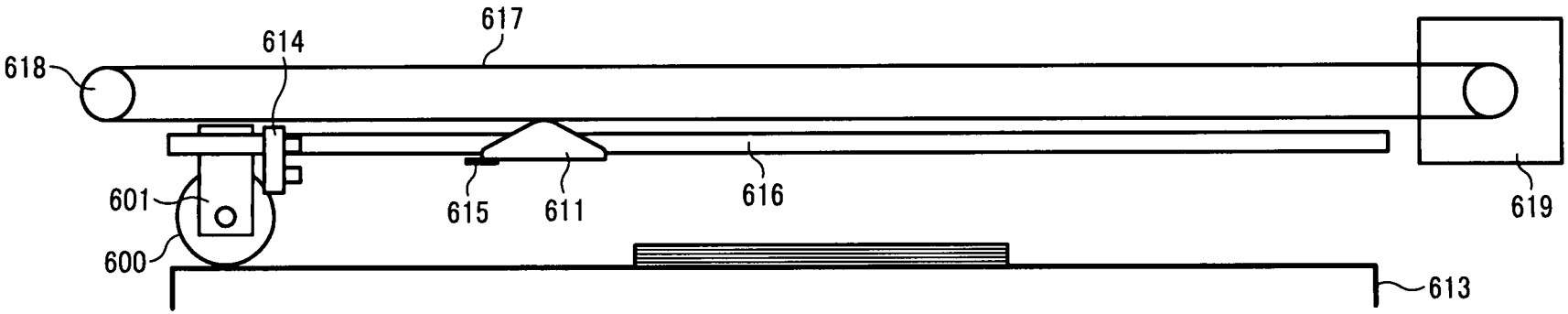
FIG. 19 is a schematic diagram of the guide mechanism for explaining its operations, depicting a state where the second guiding member slides from its HP to a position to guide the first guiding member up and then down onto a corner of the folded side.

FIGS. 18A, 18B and 19 are schematic diagrams of the guide mechanism for explaining its operations. As shown in FIGS. 18A and 18B, the guide mechanism includes a second sliding shaft 616, a second timing belt 617, a second pulley 618, and a second stepping motor 619.

The second sliding shaft 616 runs parallel to the first sliding shaft 607, i.e., in the direction perpendicular to the sheet conveying direction. The second guiding member 611 is slidably attached to the second sliding shaft 616 to slide in the direction perpendicular to the sheet conveying direction. The second guiding member 611 is fixed to the second timing belt 617 that is located above the second sliding shaft 616. The second timing belt 617 is stretched between a pulley 619*a* and the second pulley 618. The pulley 619*a* is a driving pulley and the second pulley 618 is a driven pulley and. The pulley 619*a* is provided to a driving shaft of the second stepping motor 619. With this configuration, the second guiding member 611 slides back and forth along the second sliding shaft 616 by the rotation of the second timing belt 617.

The second guiding member 611 is located upstream of the sheet with respect to the sliding direction of the first slider 608. The second guiding member 611 is arranged so that a lower surface 602*a* of the first guiding member 602 slides, accompanied by the sliding of the first slider 608, on an upper surface 611*a* of the second guiding member 611. The lower surface 602*a* and the upper surface 611*a* make a cam mechanism. That is, when the lower surface 602*a* slides on the upper surface 611*a*, the slidable pressure roller 600 moves up above the sheet surface in the presence of the elastic force of the spring 609 nevertheless, and then moves down onto the sheet surface. More particularly, the slidable pressure roller 600 is moved up before reaching a left side 603*b* of the stack of sheets 603, and then moved down on the left side 603*b*. The positions where the slidable pressure roller 600 is moved up and down depend on shape and position of the second guiding member 611.

Figure 16A:
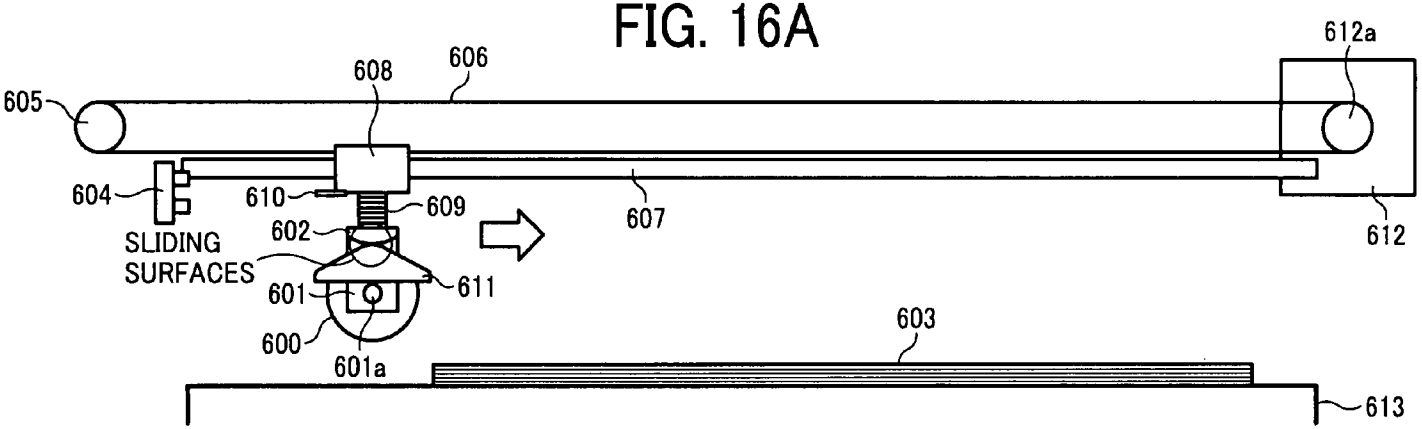
FIGS. 16A and 16B are schematic diagrams for explaining operations of the slide-pressing mechanism, depicting a state where the first guiding member is at an upmost position on the second guiding member, (stand-by position)
Figure 16B:
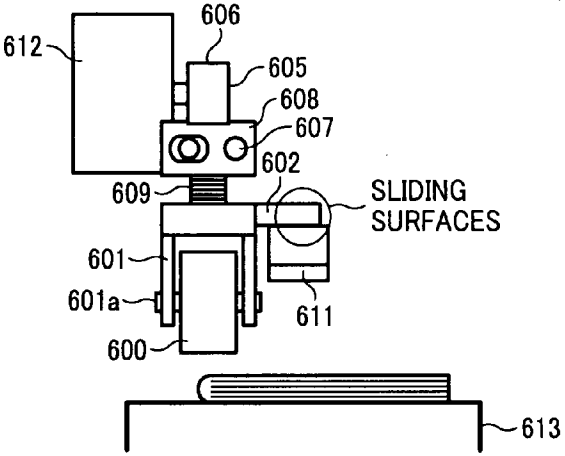
Figure 17A:
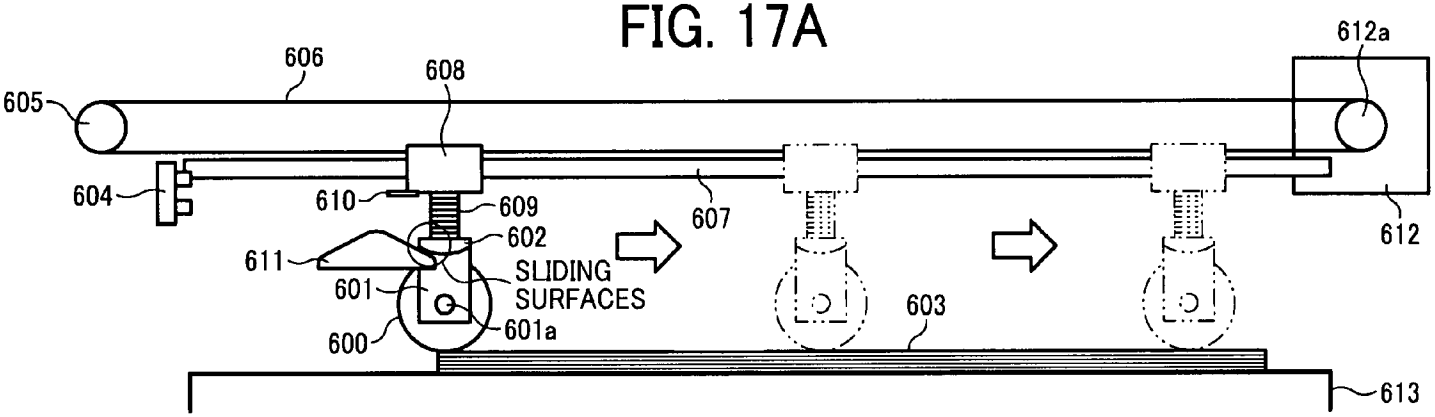
FIGS. 17A and 17B are schematic diagrams for explaining operations of the slide-pressing mechanism, depicting a state where the first guiding member slides from the second guiding member down onto the folded side.
Figure 17B:
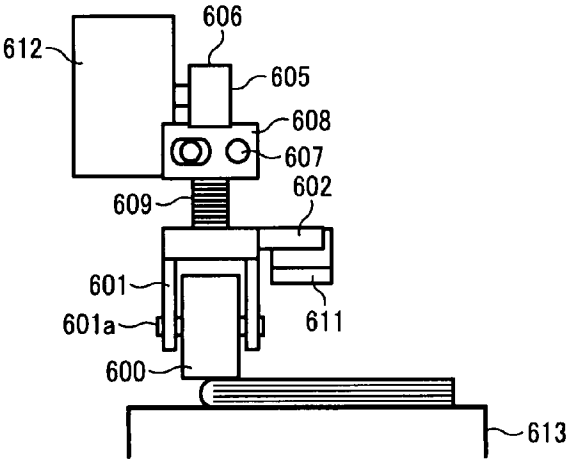

With this configuration, the slide-pressing mechanism operates as follows from the initial state shown in FIGS. 14A and 14B. The first timing belt 606 rotates by the driving force of the first stepping motor 612, and the first slider 608 slides along the first sliding shaft 607 in the sliding direction indicated by the arrow shown in FIG. 14A by the rotation of the first timing belt 606. The slidable pressure roller 600 also slides in the sliding direction accompanied by the sliding of the first slider 608. During the sliding of the slidable pressure roller 600, the curved lower surface 602*a* slides up on the slope upper surface 611*a*, and thereby the slidable pressure roller 600 is moved up. At that time, the spring 609 arranged between the holder 601 and the first slider 608 shrinks. This elastic force of the spring 609 works as a part of the pressing force to press the folded side 603*a* of the stack of sheets 603. FIGS. 16A and 16B depict a state where the slidable pressure roller 600 is on an upmost position of the second guiding member 611. After that, the slidable pressure roller 600 moves gradually down onto the left side 603*b* as shown in FIGS. 17A and 17B. The slidable pressure roller 600 slides forth along the crease of the stack of sheets 603 to a right side 603*c*. Thereafter, the slidable pressure roller 600 returns back to the HP along the sliding path same as but reverse of the forth-sliding. During this slide-pressing operation, the elastic force of the spring 609 is applied onto the crease while the slidable pressure roller 600 is sliding on the crease. Thus, the strong crease is made.

The angle of slope of the upper surface 611*a* is relatively small so that the slidable pressure roller 600 moves to a level above the folded side 603*a* of the stack of sheets 603 with a relatively small change in load when the first guiding member 602 slides on the second guiding member 611. Therefore, no trouble occurs such as the step-out of the first stepping motor 612.

It is necessary to move, based on sheet-size data received from the image forming apparatus, the second guiding member 611 to a position outside of the sheet width, and stand-by the second guiding member 611 at that position. This is because it is necessary to temporarily move up the slidable pressure roller 600 so as to fall the slidable pressure roller 600 down onto the folded side 603*a*. The second guiding member 611 is, as described above, fixed to the second timing belt 617 and moved accompanied by the rotation of the second timing belt 617. The second timing belt 617 is rotated by the driving force of the second stepping motor 619 via the second pulley 618. A shielding plate 615 is attached to the second guiding member 611 as a projection so that the shielding plate 615 shields a second light sensor 614 when the second guiding member 611 is in the HP. The distance from the HP is measured by using a pulse of the second light sensor 614. If the sheet width is small, the second guiding member 611 moves from the position as shown in FIGS. 18A and 18B to the position corresponding to the sheet width as shown in FIG. 19. In this manner, it is possible to smoothly guide the slidable pressure roller 600 to the folded side 603*a* just by adjusting the position of the second guiding member 611 in the sheet width direction.

Figure 20:
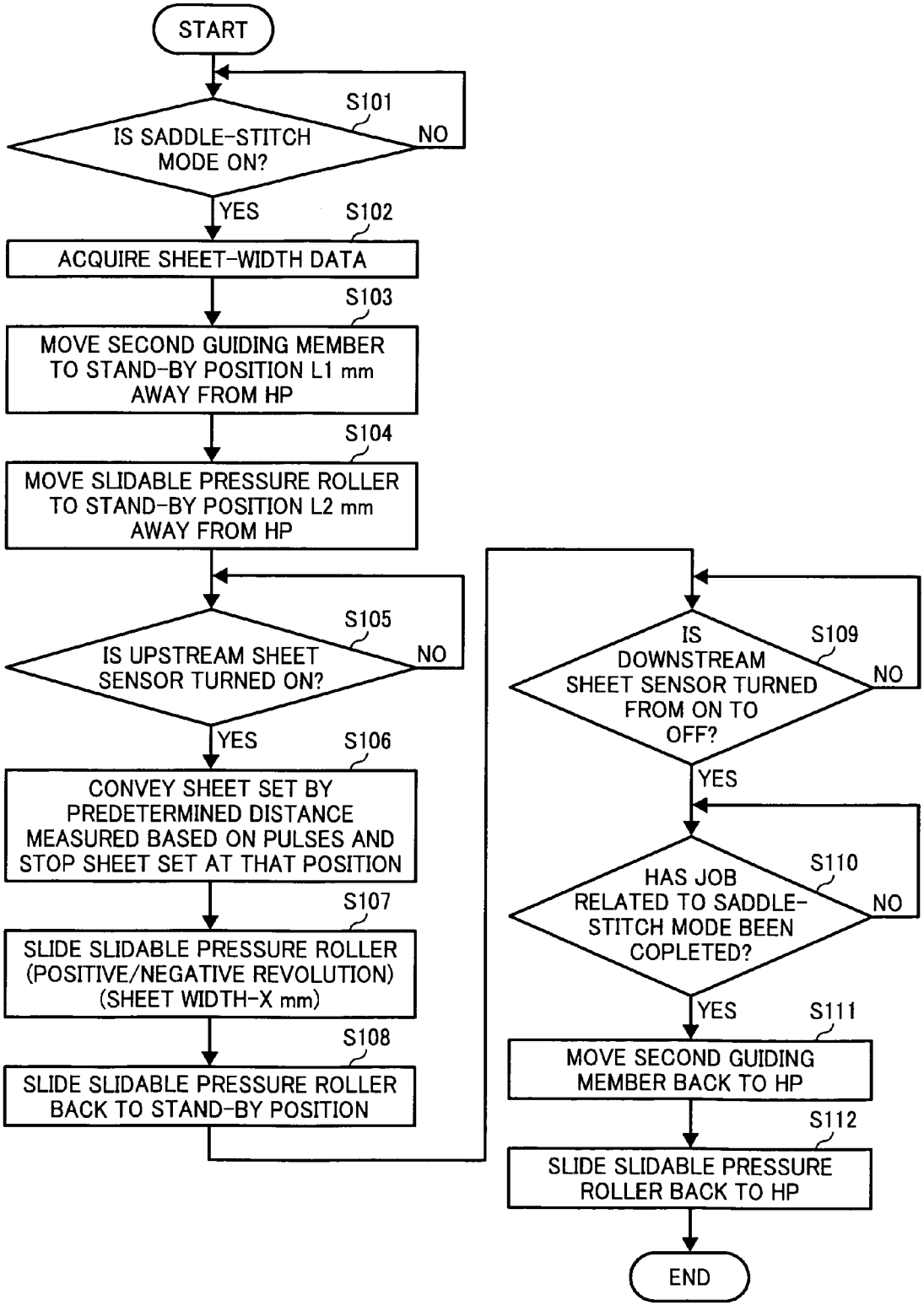
FIG. 20 is a flowchart of the slide-pressing process according to the embodiment.

FIG. 20 is a flowchart of the slide-pressing process according to the embodiment. When the stack of sheets 603 is conveyed from the image forming apparatus PR to the sheet finisher PD, i.e., when the slide-pressing process starts, the sheet finisher PD determines whether the saddle-stitch mode is ON (Step S101). If the saddle-stitch mode is ON (Yes at Step S101), the sheet finisher PD acquires the sheet-width data from the image forming apparatus PR (Step S102). The image forming apparatus PR obtains the sheet-width data by referring to a command received via an operation panel (not shown) or the size of original sheet and the size of sheet to be fed.

After acquiring the sheet-width data, the second guiding member 611 is moved to the stand-by position by the driving force of the second stepping motor 619 (Step S103). The stand-by position of the second guiding member 611 is set to a position L1 mm away from the HP shown in FIG. 18A. In other words, the second guiding member 611 stands-by at that position as shown in FIG. 19. The slidable pressure roller 600 is moved from the HP shown in FIG. 14A to the stand-by position shown in FIG. 16A by the driving force of the first stepping motor 612 (Step S104). The stand-by position of the slidable pressure roller 600 is set to a position L2 mm away from the HP. When the upstream sheet sensor 323 turns ON, i.e., the folded side 603*a* of the stack of sheets 603 passes through the upstream sheet sensor 323 (Yes at Step S105), the stack of sheets 603 is conveyed by a predetermined distance measured based on pulses and then is stopped at that position (Step S106). The stack of sheets 603 is stopped so that the folded side 603*a* is aligned with the sliding area of the slidable pressure roller 600.

The slidable pressure roller 600 is slid back and forth on the folded side 603*a* by the driving force of the first stepping motor 612 (Step S107). More particularly, the slidable pressure roller 600 moves from the position shown in FIG. 16A in the sliding direction indicated by the arrow, and falls down onto the left side 603*b* of the stack of sheets 603 as shown in FIG. 17A. After that, the slidable pressure roller 600 slides forth to a position X mm before the right side 603*c*, where X is just a small distance, and then slides back along the folded side 603*a*. The sliding motion of the slidable pressure roller 600 is controlled in an accurate manner by using the number of steps of the first stepping motor 612.

The slidable pressure roller 600 slides back from the position shown in FIG. 17A to the stand-by position shown in FIG. 16A along the sliding path same as but reverse of the forth-sliding (Step S108). When the downstream sheet sensor 324 turns from ON to OFF, i.e., the downstream sheet sensor 324 detects the back end of the stack of sheets 603 (Yes at Step S109), the sheet finisher PD checks whether the job related to the saddle-stitch mode has been completed (Step S110). If the job has been completed (Yes at Step S110), the second guiding member 611 moves back to the HP (Step S111) and the slidable pressure roller 600 slides back to the HP (Step S112). The process control then goes to end.

In this manner, as described with reference to FIGS. 16A and 17A, the slidable pressure roller 600 moves down onto the left side 603*b* of the stack of sheets 603 instead of sliding up on the left side 603*b*. Therefore, a step-out of the first stepping motor 612 due to the excessive load is prevented.

The sheet creaser incorporated in the sheet finisher is described in the embodiment. However, the sheet creaser capable of the slide-pressing can be incorporated in a sheet conveyer, an image forming apparatus, an image forming system, or the like from viewpoints of space savings. If the sheet creaser is incorporated in the sheet conveyer, the sheet creaser is, for example, placed upstream of a cutting device that cuts the stack of sheets 603.

The embodiment of the present invention brings various effects as follows.

Firstly, the slidable pressure roller 600 gradually moves up and then gradually moves down onto the folded side 603*a* instead of sliding up on the folded side 603*a*, which suppresses an amount of increase in the load on the first stepping motor 612 that drives the slidable pressure roller 600. Therefore, a step-out of the first stepping motor 612 is prevented.

Secondly, if the sheet width is variable, the second guiding member 611 moves to the stand-by position corresponding to the current sheet width so that the slidable pressure roller 600 moves down onto the folded side 603*a* without sliding up on the corner of the stack of sheets 603. In other words, it is possible to deal with the variable sheet size with the simple configuration requiring a relatively small space.

Thirdly, the slidable pressure roller 600 gradually moves up and then gradually moves down onto the folded side 603*a* instead of sliding up on the folded side 603*a*. Thus, no tear is made on the corner of the stack of sheets 603.

According to an aspect of the present invention, it is possible to provide a small-space low-cost sheet creaser capable of making a strong crease with preventing a step-out of a motor.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet creaser comprising:

a pressing unit that presses a folded side of a stack of sheets folded by a folding unit, thereby making a strong crease on the stack of sheets, the pressing unit including a pressure roller that slides on the folded side while rotating, an elastic biasing unit that presses the pressure roller in a thickness direction of the stack of sheets, and a driving unit that slides the pressure roller in a direction substantially perpendicular to a conveying direction of the stack of sheets; and a lifting unit that, when the pressure roller slides to a first position, temporarily lifts up the pressure roller, and when lifted-up pressure roller slides to a second position, lifts the lifted-up pressure roller down onto the folded side, wherein the first position and the second position are located before a corner of the folded side, whereby the pressure roller cannot slide up on the folded side, wherein the lifting unit is a cam mechanism, and when the pressure roller is sliding from a home position toward the folded side, a part of the pressure roller slides on the lifting unit before the corner of the folded side so that the lifting unit lifts up the pressure roller above the stack of sheets, wherein the cam mechanism includes a first guiding member that is attached to the pressure roller as a projection, a second guiding member on which a lower surface of the first guiding member slides so that the pressure roller is lifted up and down, and a position adjusting unit that adjusts the first position and the second position by moving the second guiding member in a sliding direction of the first guiding member to a stand-by position.

2. The sheet creaser according to claim 1, wherein the lower surface of the first guiding member is curved, and a cross section of an upper surface of the second guiding member is in a shape of inverted letter V.

3. The sheet creaser according to claim 1, further comprising a control unit that controls both adjusting performed by the position adjusting unit and driving of the driving unit, wherein the control unit causes the second guiding member to move to the stand-by position, and causes the first guiding member to slide up on the second guiding member to the second position, and causes the first guiding member to stand-by at the second position.

4. The sheet creaser according to claim 3, further comprising a conveyer unit that conveys the stack of sheets from the folding unit to the pressing unit, wherein the control unit controls the conveyer unit so that the stack of sheets is stopped at such a position that the folded side is aligned with a sliding area of the pressure roller, and causes the pressure roller to slide down from the second position onto the folded side that is aligned with the sliding area, and then causes the pressure roller to slide along the folded side.

5. The sheet creaser according to claim 4, wherein when the pressure roller slides to near other corner of the folded side, the control unit causes the pressure roller to slide back from a third position so that the pressure roller cannot slide outside of the folded side.

6. The sheet creaser according to claim 5, wherein, in a course of sliding-back of the pressure roller to the home position, the control unit causes the first guiding member to slide on the second guiding member from an end opposite to the first position so that the pressure roller is lifted up from the folded side.

7. A sheet conveyer comprising:

A sheet creaser according to claim 1 on a conveying path.

8. A sheet finisher comprising:

A sheet creaser according to claim 1.

9. An image forming apparatus comprising:

A sheet creaser according to claim 1.

10. An image forming apparatus comprising:

A sheet finisher according to claim 8.

* * * * *